US007098904B2

(12) United States Patent
Kato

(10) Patent No.: US 7,098,904 B2
(45) Date of Patent: Aug. 29, 2006

(54) DISPLAY CONTROL CIRCUIT AND DISPLAY DEVICE

(75) Inventor: Fumihiko Kato, Yamagata (JP)

(73) Assignee: NEC Electronics Corporation, Kanagawa (JP)

( * ) Notice: Subject to any disclaimer, the term of this patent is extended or adjusted under 35 U.S.C. 154(b) by 357 days.

(21) Appl. No.: 10/299,611

(22) Filed: Nov. 19, 2002

(65) Prior Publication Data

US 2003/0095118 A1 May 22, 2003

(30) Foreign Application Priority Data

Nov. 19, 2001 (JP) ..... 2001-353282

(51) Int. Cl.
*G09G 5/00* (2006.01)

(52) U.S. Cl. ..... 345/211; 345/100; 330/257

(58) Field of Classification Search ..... 345/87, 345/92, 100, 89, 690, 211; 330/253–257
See application file for complete search history.

(56) References Cited

U.S. PATENT DOCUMENTS

| | | | | |
|---|---|---|---|---|
| 5,751,186 | A * | 5/1998 | Nakao | 327/562 |
| 5,880,627 | A * | 3/1999 | Thiel, V | 327/562 |
| 6,259,322 | B1 * | 7/2001 | Muza | 330/257 |
| 6,331,847 | B1 | 12/2001 | Kim et al. | |
| 6,392,485 | B1 * | 5/2002 | Doi et al. | 330/253 |
| 6,462,735 | B1 * | 10/2002 | Naito | 345/204 |
| 6,583,661 | B1 * | 6/2003 | Tanji et al. | 327/355 |
| 6,630,863 | B1 * | 10/2003 | Tsuchiya | 330/254 |
| 2002/0067207 | A1 * | 6/2002 | Kato | 330/255 |
| 2002/0118064 | A1 * | 8/2002 | Gray | 330/253 |
| 2003/0071686 | A1 * | 4/2003 | Lemkin | 330/253 |

FOREIGN PATENT DOCUMENTS

| | | |
|---|---|---|
| EP | 0493820 A1 | 8/1992 |
| JP | 4-242788 | 8/1992 |
| JP | 10-326084 | 12/1998 |
| JP | 11-305744 | 11/1999 |
| JP | 2000-252768 | 9/2000 |
| JP | 2001-83924 | 3/2001 |
| WO | WO 98/40873 | 9/1998 |

OTHER PUBLICATIONS

Korean Office Action of Oct. 28, 2004.
English Translations of the above-referenced Office Action.

* cited by examiner

*Primary Examiner*—Richard Hjerpe
*Assistant Examiner*—Kimnhung Nguyen
(74) *Attorney, Agent, or Firm*—Darryl G. Walker; Bradley T. Sako

(57) ABSTRACT

A display control circuit (100) that may have a reduced power consumption has been disclosed. A display control (100) may include a plurality of output cells (3-1 to 3-N). Each output cell may include an amplifying circuit (35) for driving an output terminal (PS) to essentially a gray level voltage according to a display data (DIN). Amplifying circuit (35) may include a dead zone in which an output may be a high impedance when the output terminal is substantially the gray level voltage. An amplifying circuit (21) may be included to provide a drive for the output terminal (PS) in the vicinity of the gray level voltage. Amplifying circuit (21) may not include the dead zone. In this way, by providing the large drive by amplifying circuit (35) and a smaller drive strength by amplifying circuit (21), current consumption may be reduced.

19 Claims, 11 Drawing Sheets

DISPLAY CONTROL CIRCUIT AND DISPLAY DEVICE

TECHNICAL FIELD

The present invention relates generally to a display control device for controlling display of a plurality of unit pixels arranged in a matrix and more particularly to a display control device including a source driver for supplying a data voltage corresponding to image information to a data line in a display device such as an active matrix drive liquid crystal display device, organic EL (electro-luminescent) display device, or the like.

BACKGROUND OF THE INVENTION

Due to high quality, compactness, and low power display, a flat panel display device such as a TFT (thin film transistor) type liquid crystal display device is widely used as a display device in personal computers (such as laptops), mobile telephones, and the like.

A flat panel display device includes a plurality of data lines and a plurality of scan lines. Active elements, such as TFTs, are arranged in a matrix at intersections of data lines and scan lines. When a selection voltage is supplied to a corresponding scan line, corresponding active elements (in the row formed by the corresponding scan line) are turned on and voltages supplied to the data lines are accumulated in display cells (for example, on a liquid crystal element). When the scan line is in a non-selection state, the voltages accumulated in the display cells are held to be imparted to a liquid crystal, thereby conducting display. A display cell is provided corresponding to each dot (pixel) of image display data and controlled such that the voltage level stored is changed according to a gray level of each dot display. In addition, when color display is conducted, three display cells each having one of three primary colors are provided for each dot and respective gray levels of the three primary colors are controlled by the voltages held in each of the three display cells to conduct color display.

A display control circuit includes a source driver for driving the source line which can be a data line. Referring now to FIG. 10, a circuit schematic diagram of a conventional source driver is set forth and given the general reference character 1000. Conventional source driver 1000 is disclosed in Japanese Patent Application Laid-Open 4-242788 A (JP 4-242788 A). In conventional source driver 1000, image data of each pixel is provided on a data bus DIN as digital data. Bus DIN is connected with a plurality of output cells (1003-1 to 1003-N). Gray level voltages (VR1 to VR64) are provided to respective output cells (1003-1 to 1003-N) from a γ power source generating circuit 1. According to the description, in a display device for conducting a 64-gray level display for respective colors of red (R), green (G), and blue (B), 64 gray level voltages (VR1 to VR64) are generated. These voltages are obtained from respective contact points between 65 resistors connected in series between power sources (4-1 and 4-2). Resistance values of the respective resistors connected in series are not uniform but are resistance values γ-corrected such that light and dark in the respective gray levels are natural gray levels when viewed by a person.

The image data to respective source lines of the display device are serially transferred to the data bus DIN. Each output cell (1003-1 to 1003-N) includes a latch 31, a digital to analog (D/A) converter 32 and a class AB amplifying circuit 1034. When corresponding image data is transferred in response to a data latch signal DL, latch 31 latches the data. The output of latch 31 is provided to a D/A converter 32. D/A converter decodes the image data to select and provide a corresponding gray level voltage (VR1 to VR64). The output of D/A converter 32 is provided to the non-inverting input of class AB amplifying circuit 1034. Class AB amplifying circuit 1034 is an operational amplifier in which the output is directly fed back to the inverting input. Class AB amplifying circuit 1034 operates as a voltage follower. Class AB amplifying circuit 1034 provides a buffer function for the gray level voltage (VR1 to VR64) provided at an output terminal (PS-1 to PS-N) for a corresponding output cell (1003-1 to 1003-N).

Each output terminal (PS-1 to PS-N) is connected to a corresponding source line of the display device. Thus, each output terminal (PS-1 to PS-N) has an extremely large load capacitance. Accordingly, each output terminal (PS-1 to PS-N) is driven by a class AB amplifying circuit 1034 providing a buffer, so that high-speed operation may be achieved.

However, because each source line has an extremely large load capacitance, an extremely high current drive capacity can be desirable for the class AB amplifying circuit 1034. As a result, even after an output terminal (PS-1 to PS-N) is driven up to a target gray level voltage (VR1 to VR64), class AB amplifying circuit 1034 consumes current through a driver circuit portion that provides a current path from a high voltage level to a low voltage level through the output terminal (PS-1 to PS-N). In addition, the current increases proportionally to an increase in size of the transistors in the driver circuit portion of class AB amplifying circuit 1034. Thus, even if a gray level voltage (VR1 to VR64) provided to an output terminal (PS-1 to PS-N) is not changed, class AB amplifying circuit 1034 can consumes an extremely large amount of power.

Referring now to FIG. 11, a circuit schematic diagram of a conventional source driver is set forth and given the general reference character 1100. Conventional source driver 1100 is disclosed in Japanese Patent Application Laid-Open 10-326084 A (JP 10-326084 A). Conventional source driver 1100 differs from conventional source driver 1000 in that class AB amplifying circuit 1034 is not included in output cells (1103-1 to 1103-N). Instead a buffer circuit 1102 is included between γ power source generating circuit 1 and output cells (1103-1 to 1103-N) to provide gray level voltages (VR1 to VR64). Otherwise, conventional source driver 1100 has the same configuration as conventional source driver 1000 and therefore the same reference characters are provided therefore.

Buffer circuit 1102 drives an output terminal (PS-1 to PS-N) together with an internal bus line for supplying the gray level voltage (VR1 to VR64). As a result, in conventional source driver 1100, it is necessary to further increase the current capacity of the transistors in the output portion of each class AB amplifying circuit in buffer 1102 as compared to class AB amplifying circuit 1034 in conventional source driver 1000. In this way, power consumption is further increased.

According to conventional source drivers (1000 and 1100), buffers including class AB amplifying circuits for high-speed operation can have large power consumption.

In recent years, the use of flat display devices has increased. When used in a portable device or the like, it is desirable for power consumption to be minimized to increase battery lifetime.

In order to further reduce power consumption while maintaining substantially high speed operation, a conventional source driver is disclosed in Japanese Patent Application laid-open no. 11-305744 A (JP 11-305744 A). Referring now to FIG. 12, a circuit schematic diagram of a conventional output cell of a conventional source driver is set forth and given the general reference character 1200. Conventional output cell 1200 is disclosed in JP 11-305744 A. In conventional output cell 1200 of a conventional source driver, image digital data DIN and gray voltage levels (V1 to VM) are provided to a decoder 1230. Decoder 1230 selects and provides a gray level voltage (V1 to VM) according to a value of data DIN. Thus, decoder 1230 is equivalent to a D/A converter (32 and 1133) illustrated in conventional source drivers (1000 and 1100), respectively. However, in conventional output cell 1200 of a conventional source driver, an output terminal OUT is driven by a voltage follower configured operational amplifier circuit 1234. Operational amplifier circuit 1234 serves as a buffer and can be made active or inactive in response to a control signal CONT. According to conventional output cell 1200, when control signal CONT has an active level (low level), operational amplifier circuit 1234 is activated and drives output terminal OUT. On the other hand, when control signal CONT has an inactive level (high level), the operational amplifier circuit 1234 is disabled or inactive and has a high impedance output. In this way, the power consumption of operational amplifier circuit 1234 becomes substantially zero.

Conventional output cell 1200 includes a switch circuit 1236 connected between the output of decoder 1230 and output terminal OUT. Switch circuit 1236 includes an inverter 1238 and a transmission gate TG1. When control signal CONT becomes a high level, switch circuit 1236 is turned on and transmission gate TG1 provides a low impedance path between the output of decoder 1230 and output terminal OUT. In this way, when control signal CONT is in the inactive level, operational amplifier circuit 1234 is disabled and the gray level voltage (V1 to VM) is provided to output terminal OUT directly by decoder 1230 through transmission gate TG1.

Therefore, every time new image data DIN is supplied, control signal CONT becomes a low level and output terminal OUT is driven to a gray level voltage (V1 to VM) or its vicinity by operation amplifier circuit 1234 at a high speed. After that, the control signal CONT transitions to a high level so that operational amplifier circuit 1234 is disabled so that power consumption is reduced and output terminal OUT is directly driven by decoder 1230 to a gray level voltage (V1 to VM). Thus, according to conventional output cell 1200, power consumption is reduced while keeping a substantial high-speed operation.

According to conventional output cell 1200 of a conventional source driver, control signal CONT is used to commonly control buffer operational amplifier circuit 1234 and switch circuit 1236, thus, the operation/non-operation timings of the respective elements are provided by control signal CONT. However, times required for charging and/or discharging a display cell and a source line vary greatly according to a display pattern. For example, charging the display cell and source line up to 4.8 V when each have an initial voltage of 0.2 V takes a long time. In contrast to this, when the display cell and the source line each initially have a potential of 4.8 V, providing a 4.8 V takes no time or current. However, switching control signal CONT in consideration of the times required for charging and/or discharging the source line according to the display pattern may be substantially impossible. If control signal CONT is switched to the inactive level too early, a desired gray level may not be obtained because the source line and display cell has not been sufficiently charged or discharged. On the other hand, if control signal CONT is switched to the inactive level too late, excess current is consumed by operational amplifier circuit 1234 and current consumptions benefits are reduced.

Furthermore, a design of a conventional source driver using conventional output cell 1200 may be complicated due to the generation of control signal CONT to provide such timing.

In view of the above discussion, it would be desirable to provide a display control circuit as a source driver in which high-speed operation may be conducted without conventional timing control as shown above. It would also be desirable to provide a display control circuit as a source driver in which high-speed operation may be conducted while lower power consumption may be realized.

SUMMARY OF THE INVENTION

According to the present embodiments, a display control circuit that may have a reduced power consumption has been disclosed. A display control may include a plurality of output cells. Each output cell may include an amplifying circuit for driving an output terminal to essentially a gray level voltage according to a display data. Amplifying circuit may include a dead zone in which an output may be a high impedance when the output terminal is substantially the gray level voltage. An amplifying circuit may be included to provide a drive for the output terminal in the vicinity of the gray level voltage. Amplifying circuit may not include the dead zone. In this way, by providing the large drive by amplifying circuit and a smaller drive strength by amplifying circuit, current consumption may be reduced.

According to one aspect of the embodiments, a display control circuit may include an amplifying circuit and a drive voltage compensation circuit. An amplifying circuit may receive a first gray level voltage at an amplifying circuit input and provide an amplifying circuit output having a high impedance when the first gray level voltage and a voltage level of the amplifying circuit output are at least substantially the same. A drive voltage compensation circuit may compensate the voltage level of the output terminal based on the gray level voltage.

According to another aspect of the embodiments, the amplifying circuit may include a n-type insulated gate field effect transistor (IGFET) and a p-type IGFET. An n-type IGFET may have a drain connected to a high potential power source, a gate connected to the amplifying circuit input, and a source connected to the amplifying circuit output. A p-type IGFET may have a drain connected to a low potential power source, a gate connected to the amplifying circuit input, and a source connected to the amplifying output.

According to another aspect of the embodiments, the amplifying circuit may include a first differential input circuit and a second differential input circuit. The first differential input circuit may have a first input connected to the amplifying circuit input and a second input connected to the amplifying circuit output and a first output connected to provide control for turning on and turning off a first driver circuit. The second differential input circuit may have a third input connected to the amplifying circuit input and a fourth input connected to the amplifying circuit output and a second output connected to provide control for turning on and turning off a second driver circuit.

According to another aspect of the embodiments, the first output driver circuit may raise the voltage of the output terminal when turned on in response to the voltage of the amplifying circuit input being higher than the voltage of the amplifying circuit output. The second output driver circuit may lower the voltage of the output terminal when turned on in response to the voltage of the amplifying circuit input being lower than the voltage of the amplifying circuit output.

According to another aspect of the embodiments, the display control circuit may include a voltage generating circuit and a first selector circuit. A voltage generating circuit may provide a plurality of reference voltages. A first selector circuit may select the first gray level voltage from the plurality of reference voltages based on a display data. The drive voltage compensation circuit may include a buffer circuit and a second selector circuit. A buffer circuit may receive the plurality of reference voltages and provide a plurality of buffered reference voltages. A second selector circuit may select one of the plurality of buffered reference voltages based on the display data and provide the one of the plurality of buffered reference voltages to the amplifying circuit output.

According to another aspect of the embodiments, the buffer circuit may include a plurality of operational amplifying circuits. Each one of the plurality of operational amplifying circuits may be configured as a voltage follower and may receive one of the plurality of reference voltages and provide one of the buffered reference voltages.

According to another aspect of the embodiments, the display control circuit may drive a plurality of output terminals based on different display data. Each one of the plurality of output terminals may be associated with a corresponding amplifying circuit, first selector, and second selector, and may be connected to a corresponding amplifying circuit output.

According to another aspect of the embodiments, a display control circuit may drive each of a plurality of output terminals to a predetermined gray level voltage selected from a plurality of gray level voltages based on display data. A display control circuit may include a plurality of output circuits. Each output circuit may include a first amplifying circuit and a second amplifying circuit. A first amplifying circuit may be connected to receive essentially the predetermined gray level voltage and may have a first amplifying circuit output connected to a corresponding one of the plurality of output terminals. A first amplifying circuit may include a dead zone in which the first amplifying circuit output may become a high impedance when the corresponding one of the output terminal has a voltage level that is substantially the predetermined gray level voltage. A second amplifying circuit may receive essentially the predetermined gray level voltage and may have a second amplifying circuit output connected to the corresponding one of the plurality of output terminals. The second amplifying circuit may not have the dead zone.

According to another aspect of the embodiments, the first amplifying circuit may receive a first control signal for setting the first amplifying circuit into an active/non-active state.

According to another aspect of the embodiments, the second amplifying circuit may receive a second control signal for setting the first amplifying circuit into an active/non-active state.

According to another aspect of the embodiments, the first amplifying circuit includes a n-type IGFET and a p-type IGFET. An n-type IGFET may have a drain connected to a high potential power source, a gate connected to the amplifying circuit input, and a source connected to the amplifying circuit output. A p-type IGFET may have a drain connected to a low potential power source, a gate connected to the amplifying circuit input, and a source connected to the amplifying output.

According to another aspect of the embodiments, the first amplifying circuit may include a first differential input circuit, a second differential input circuit, and a driver circuit. A first differential input circuit may have a first input connected to receive the essentially the gray level voltage and a second input connected to the output terminal and may provide a first driver control signal. A second differential input circuit may have a third input connected to receive the essentially the gray level voltage and a fourth input connected to the output terminal and may provide a second driver control signal. A driver circuit may receive the first and second driver control signals and may provide the first amplifying circuit output.

According to another aspect of the embodiments, the display control circuit may include a reference voltage generating circuit. A reference voltage generating circuit may provide a plurality of reference voltages. Each output circuit may include a first selector coupled to receive the reference voltages and provide the essentially the gray level voltage based on the display data.

According to another aspect of the embodiments, the display control circuit may include a reference voltage generating circuit and a buffer circuit. A reference voltage generating circuit may provide a plurality of reference voltages. A buffer circuit may include a plurality of third amplifier circuits and may provide a plurality of buffered reference voltages to each of the plurality of output circuits. The number of the plurality of third amplifier circuits enabled may depend on a gray level number mode of operation.

According to another aspect of the embodiments, a display control circuit may drive each of a plurality of output terminals to a predetermined gray level voltage selected from a plurality of gray level voltages based on display data. A display control circuit may include a plurality of output circuits and a buffer circuit. A buffer circuit may include a plurality of first amplifying circuits that may receive a plurality of reference voltages and provide a plurality of buffered reference voltages. The buffered reference voltages may essentially correspond to the plurality of gray level voltages. Each output circuit may include a second amplifying circuit. A second amplifying circuit may be connected to receive essentially the predetermined gray level voltage at a second amplifying circuit input and may have a second amplifying circuit output connected to a corresponding one of the plurality of output terminals. A second amplifying circuit may include a dead zone in which the second amplifying circuit output may become a high impedance when the corresponding one of the output terminals has a voltage level that is substantially the predetermined gray level voltage. The plurality of first amplifying circuits may not have the dead zone and the buffer may drive each of the output terminals to the corresponding predetermined gray level voltage.

According to another aspect of the embodiments, the display control circuit may include a reference voltage generating circuit. A reference voltage generating circuit may provide a plurality of reference voltages. Each output circuit may include a first selector coupled to receive the reference voltages and provide the essentially the gray level voltage based on the display data.

According to another aspect of the embodiments, each output circuit may include a second selector connected to receive the plurality of buffered reference voltages and providing the predetermined gray level voltage to the output terminal based on the display data.

According to another aspect of the embodiments, the second amplifying circuit includes a n-type IGFET and a p-type IGFET. An n-type IGFET may have a drain connected to a high potential power source, a gate connected to the second amplifying circuit input, and a source connected to the second amplifying circuit output. A p-type IGFET may have a drain connected to a low potential power source, a gate connected to the second amplifying circuit input, and a source connected to the second amplifying output.

According to another aspect of the embodiments, the second amplifying circuit may include a first differential input circuit, a second differential input circuit, and a driver circuit. A first differential input circuit may have a first input connected to receive the essentially the gray level voltage and a second input connected to the output terminal and may provide a first driver control signal. A second differential input circuit may have a third input connected to receive the essentially the gray level voltage and a fourth input connected to the output terminal and may provide a second driver control signal. A driver circuit may receive the first and second driver control signals and may provide the first amplifying circuit output.

According to another aspect of the embodiments, the display control circuit may control a display device in which a plurality of unit pixels may be arranged in a matrix in vicinities of respective intersections of a plurality of data lines and a plurality of scan lines and the plurality of data lines may be driven by the plurality of output terminals.

DETAILED DESCRIPTION OF THE EMBODIMENTS

Various embodiments of the present invention will now be described in detail with reference to a number of drawings.

Figure 1:
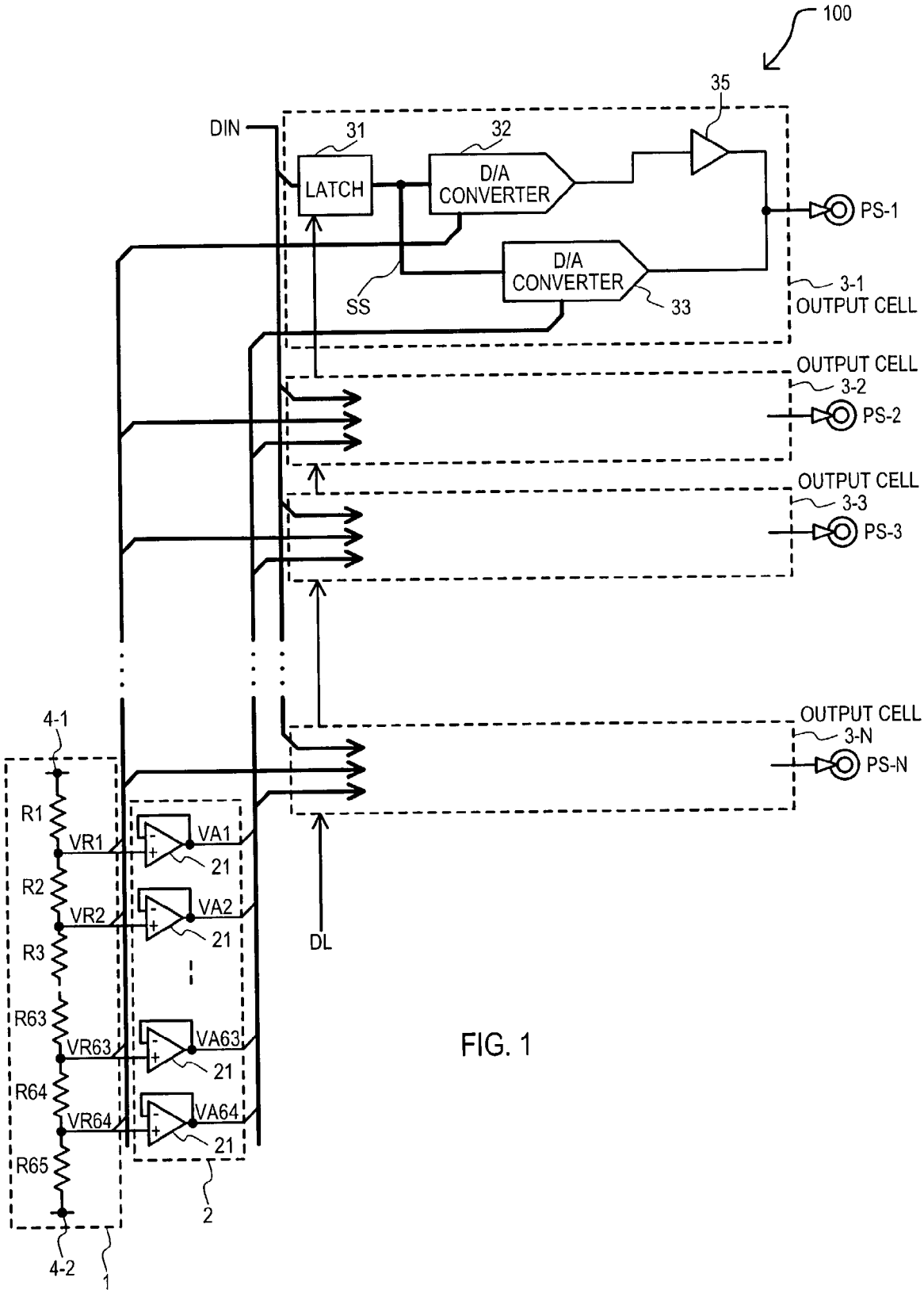
FIG. 1 is a circuit schematic diagram of a display control circuit according to an embodiment.

Referring now to FIG. 1, a circuit schematic diagram of a display control circuit according to an embodiment is set forth and given the general reference character 100. Display control circuit 100 may include similar constituents as conventional display control circuits (1000 and 1100). Such constituents may be referred to by the same reference character and their description may be omitted.

Display control circuit 100 may include a γ power source generating circuit 1, a buffer 2, and output cells (3-1 to 3-N). γ power source generating circuit 1 may include resistors (R1 to R65) connected in series between a high power source 4-1 and a low power source 4-2. Tap points between resistors (R1 to R65) may provide reference voltage signals (VR1 to VR64). Reference voltage signals (VR1 to VR64) may correspond to gray level voltages. Buffer 2 may include 64 class AB amplifying circuits 21. Each class AB amplifying circuit 21 may receive a respective reference voltage signal (VR1 to VR64) at a non-inverting input terminal and may provide a respective amplified reference voltage signal (VA1 to VA64) at an output terminal. Each class AB amplifying circuit 21 may have the output terminal connected to an inverting input terminal.

Each output cell (3-1 to 3-N) may receive an image data signal DIN, reference voltage signals (VR1 to VR64), amplified reference voltage signals (VA1 to VA64), and a data latch signal DL and may provide an image signal (PS-1 to PS-N) as an output. Each output cell (3-1 to 3-N) may include a latch 31, digital to analog (D/A) converters (32 and 33), and a class B amplifying circuit 35. Latch 31 may receive image data signal DIN and data latch signal DL and may provide a selection signal SS to D/A converters (32 and 33). D/A converter 32 may receive selection signal SS and reference voltage signals (VR1 to VR64) and may provide an output as an input to class B amplifying circuit 35. Class B amplifying circuit 35 may have an output connected to provide an image signal (PS-1 to PS-N). D/A converter 33 may receive selection signal SS and amplified reference voltage signals (VA1 to VRA4) and may have an output connected to provide an image signal (PS-1 to PS-N).

Figure 10:
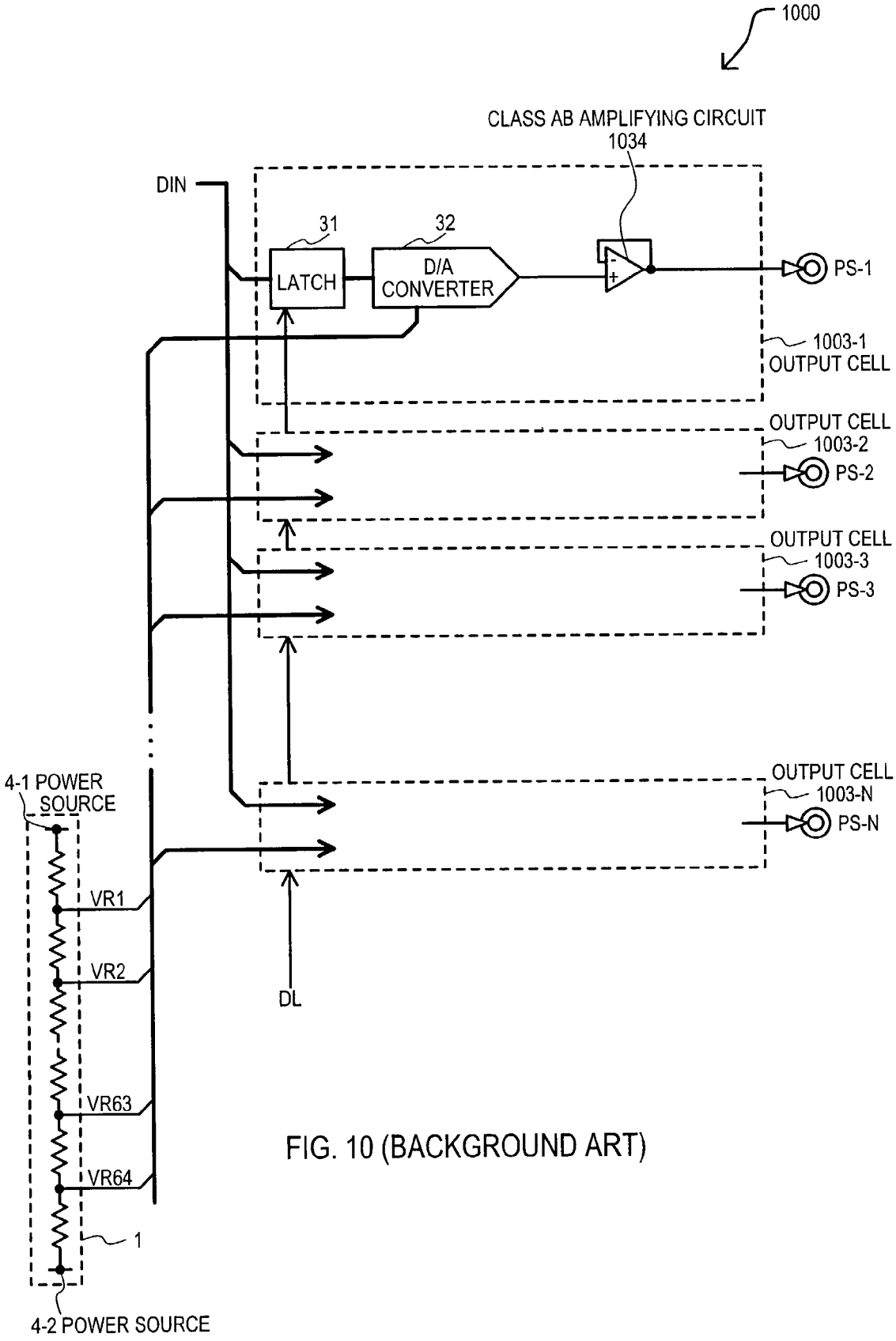
FIG. 10 (BACKGROUND ART)
FIG. 10 is a circuit schematic diagram of a conventional source driver.
Figure 11:
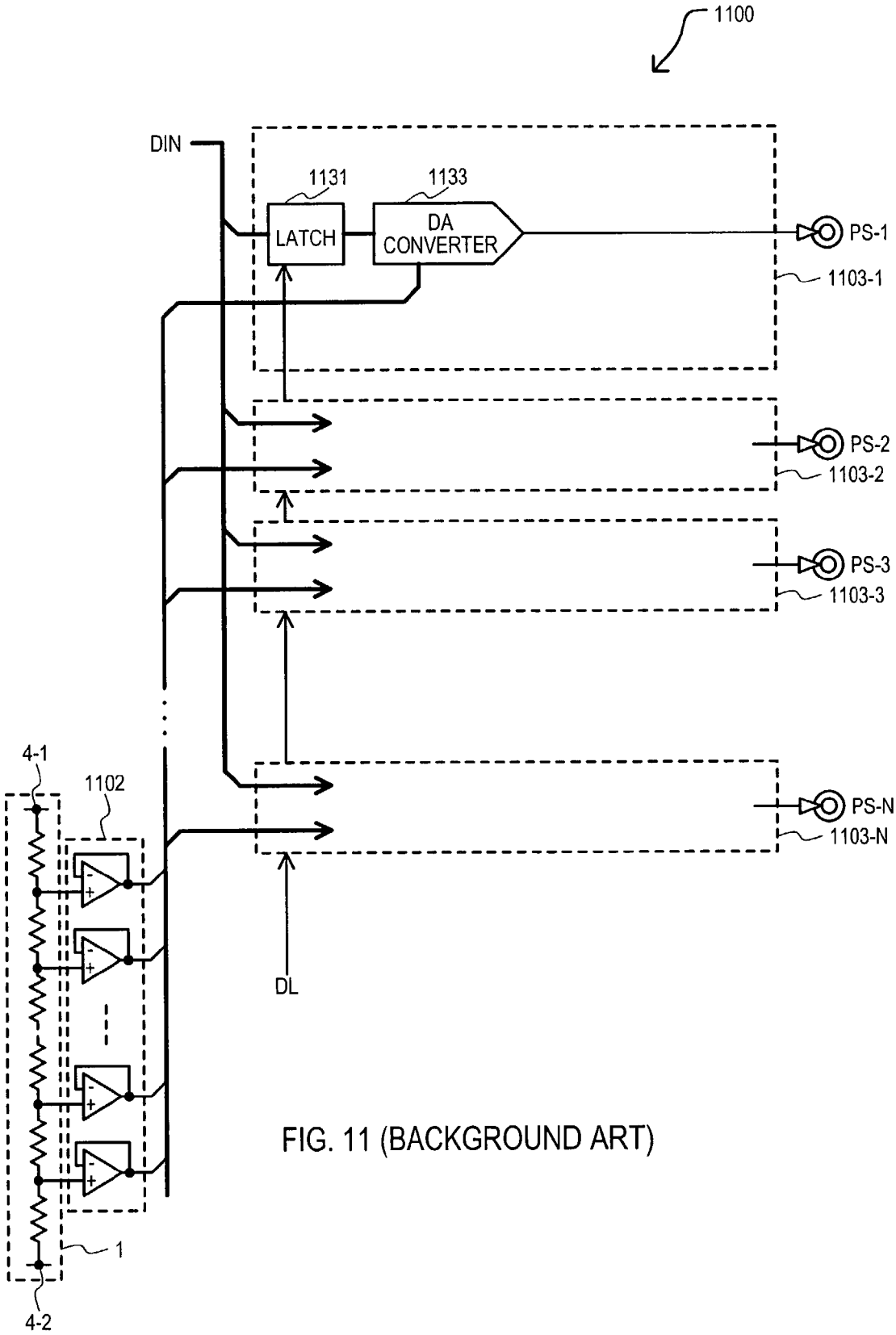
FIG. 11 (BACKGROUND ART)
FIG. 11 is a circuit schematic diagram of a conventional source driver.
Figure 12:
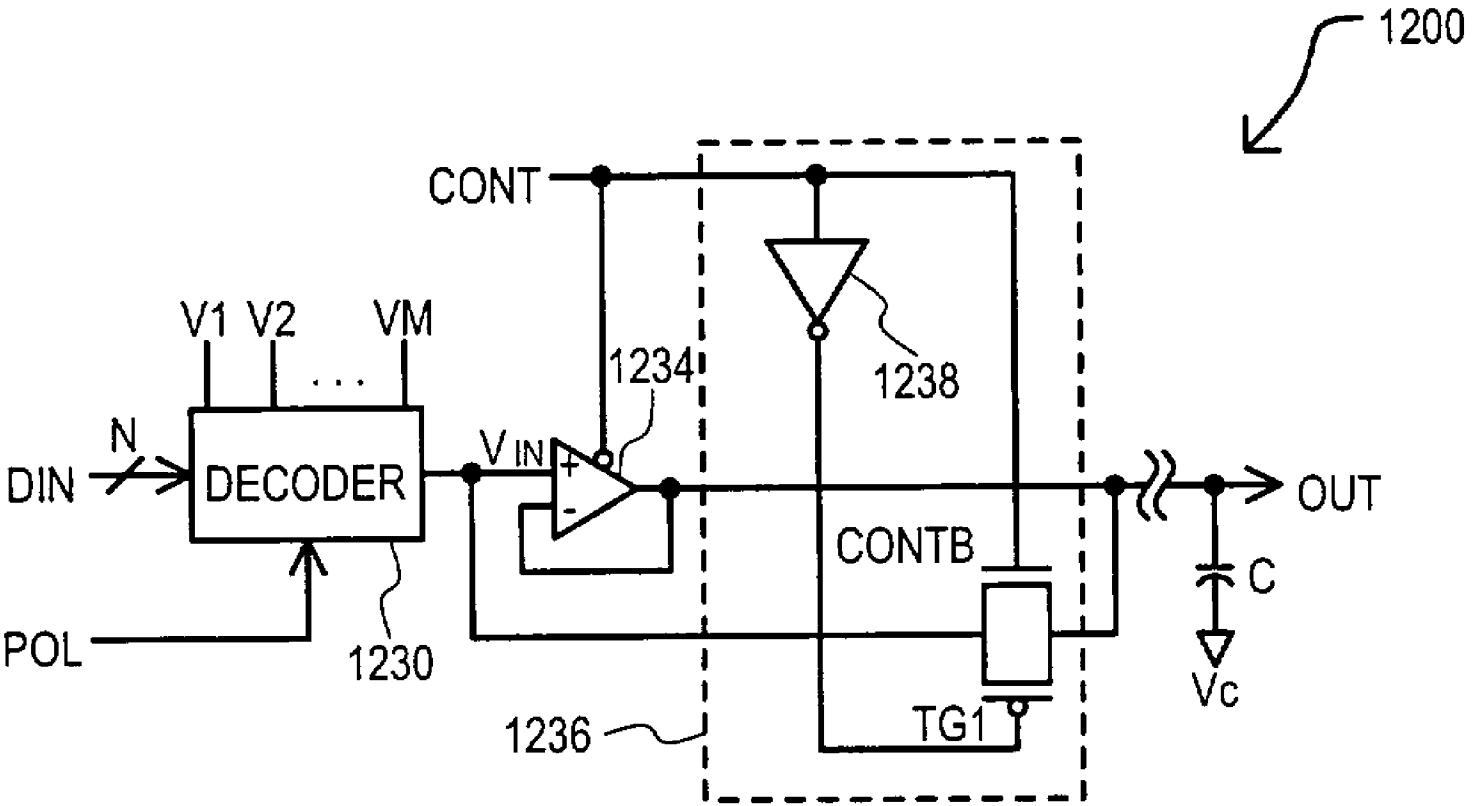
FIG. 12 (BACKGROUND ART)
FIG. 12 is a circuit schematic diagram of a conventional output cell of a conventional source driver.

Class B amplifying circuit 35 may differ from a class AB amplifying circuit (for example class AB amplifying circuit 1034 of FIG. 10 and/or class AB amplifying circuit 21) in that class B amplifying circuit 35 may form a buffer having a dead zone in which an output may have a high impedance. The dead zone of class B amplifying circuit 35 may exist when an input voltage is essentially the same as an output voltage. Class AB amplifying circuit 1034 continuously drives an output terminal PS at a low impedance even when the output voltage is equal to the input voltage and thus does not have a dead zone.

Structures of class AB amplifying circuit 21 and class B amplifying circuit 35 will now be described in detail with reference to FIGS. 2 and 3, respectively.

Figure 2:
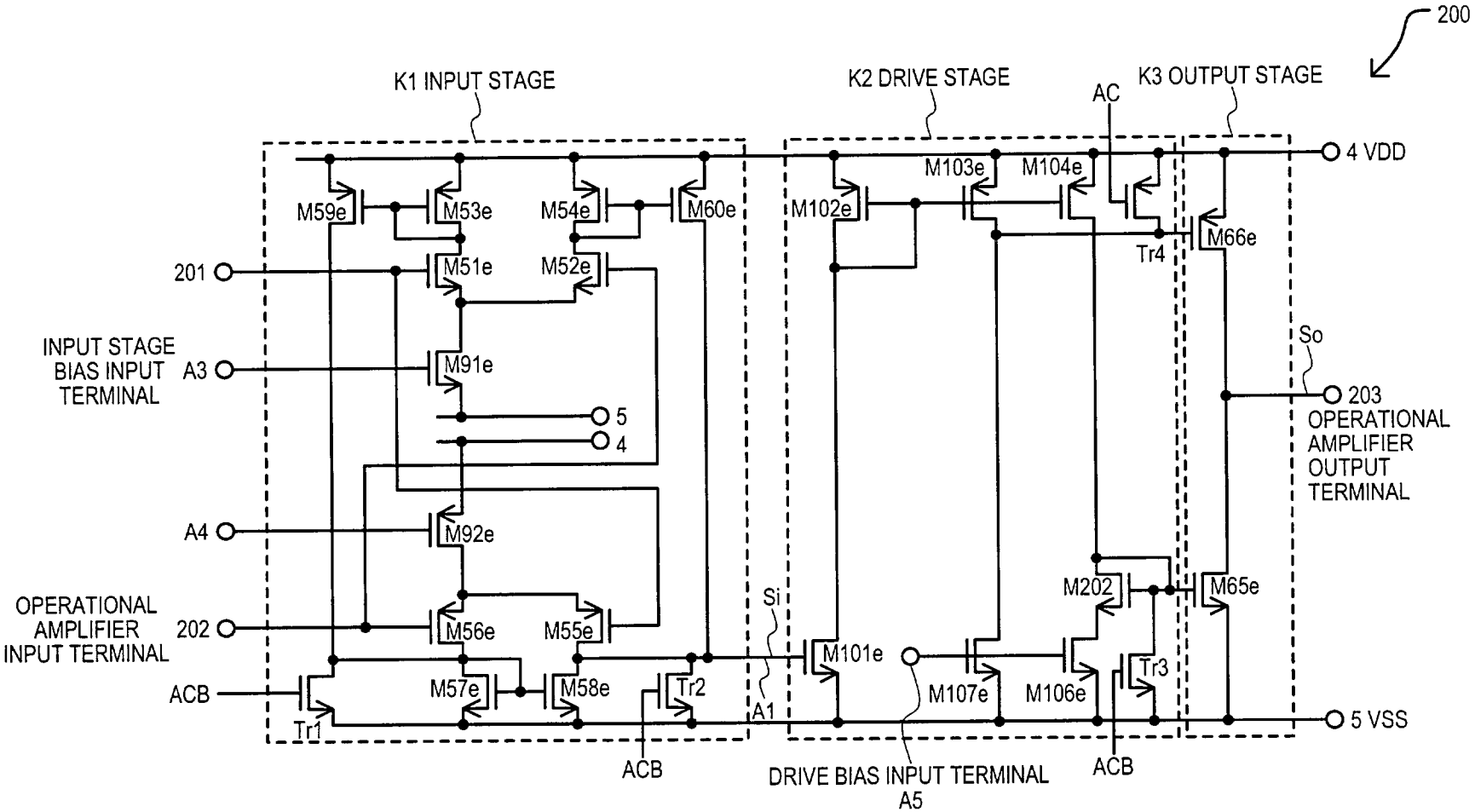
FIG. 2 is a circuit schematic diagram of a class AB amplifying circuit.
Figure 3:
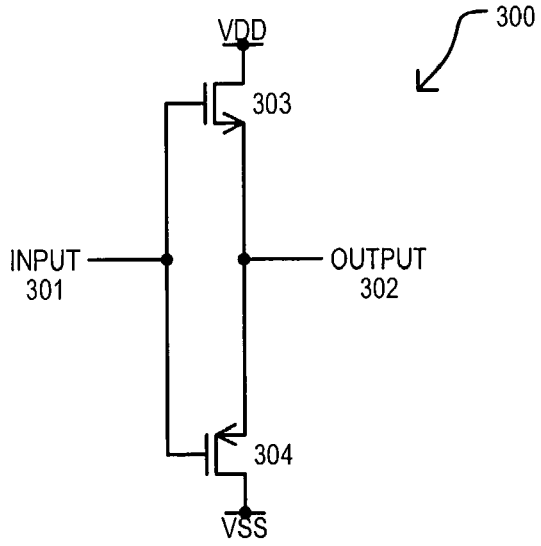
FIG. 3 is a circuit schematic diagram of class B amplifying circuit according to an embodiment.

Referring now to FIG. 2, a circuit schematic diagram of a class AB amplifying circuit is set forth and given the general reference character 200. Class AB amplifying circuit 200 is disclosed (FIG. 16) in Japanese Patent Application No. 11-239303 (JP 2000-252768 A) by the present inventor. Class AB amplifying circuit 200 may be used as class AB amplifying circuit 21 in display control circuit 100 of FIG. 1.

Class AB amplifying circuit 200 receives a differential voltage at operational amplifier input terminals (201 and 202) and provides an amplified output voltage at an operational amplifier output terminal 203. Class AB amplifying circuit 200 may include an input stage K1, a drive stage K2, and an output stage K3. Input stage K1 may receive bias voltages at input stage bias input terminals (A3 and A4) to provide constant current sources. Drive stage K2 may receive a bias voltage at a drive stage bias input terminal A5 to provide a constant current source. Control terminals (AC and ACB) may be control terminals for switching class AB amplifying circuit 200 between activation and non-activation. When class AB amplifying circuit 200 is activated, control terminal AC may receive a high level signal and control terminal ACB may receive a low level signal. In contrast, when class AB amplifying circuit 200 is non-activated, control terminal AC may receive a low level signal and control terminal ACB may receive a high level signal.

When a predetermined intermediate voltage is being provided at output terminal 203 of class AB amplifying circuit 200 illustrated in FIG. 2, bias voltages are applied to both the gate of an output stage pull-up transistor M66*e* and the gate of an output stage pull-down transistor M65*e*. In this condition, both output stage pull-up transistor M66*e*and output stage pull-down transistor M65*e* are turned on and the voltage of output terminal 203 is determined accordingly while a flow through current can always flow from a higher power source VDD to a lower power source VSS through output stage pull-up transistor M66*e* and output stage pull-down transistor M65*e*. In particular, when output terminal 203 is drivein at low impedance and high speed as in class AB amplifying circuit 1034 shown in FIG. 10, it is desirable for a considerable amount of current to flow though both output stage pull-up transistor M66*e*and output stage pull-down transistor M65*e*.

The operation and structure of a class B amplifying circuit will now be described with reference to FIG. 3. Referring now to FIG. 3, a circuit schematic diagram of class B amplifying circuit according to an embodiment is set forth and given the general reference character 300. Class B amplifying circuit 300 may be used as class B amplifying circuit 35 in display control circuit 100 of FIG. 1. Class B amplifying circuit 300 may include a n-type IGFET (insulated gate field effect transistor) 303 configured as a source follower and a p-type IGFET 304 configured as a source follower. N-type IGFET 303 may have a drain connected to a high voltage power source VDD, a source connected to an output terminal 302, and a gate connected to an input terminal 301. P-type IGFET 304 may have a drain connected to a low voltage power source VSS, a source connected to an output terminal 302, and a gate connected to an input terminal 301.

N-type IGFET 303 and p-type IGFET 304 may be a n-type MOS (metal (conductor)-oxide (insulator)-semiconductor) FET and a p-type MOSFET, respectively.

Class B amplifying circuit 300 differs from a common inverter (for example an inverter formed with complementary IGFETs) in that the n-type IGFET 303 is connected to a high voltage power source VDD and the p-type IGFET 304 is connected to a low voltage power source VSS.

In class B amplifying circuit 300, when a voltage at input terminal 301 is higher by a threshold voltage of n-type IGFET 303 than the voltage at output terminal 302, n-type IGFET 303 forming a source follower circuit may be turned on. In this way, the voltage of output terminal 302 may be pulled higher and a potential difference between a signal at input terminal 301 and a signal at output terminal 302 may be reduced. When a voltage at input terminal 301 is lower by an absolute value of a threshold voltage of p-type IGFET 304 than the voltage at output terminal 302, p-type IGFET 304 forming a source follower circuit may be turned on. In this way, the voltage of output terminal 302 may be pulled lower and a potential difference between a signal at input terminal 301 and a signal at output terminal 302 may be reduced.

On the other hand, when a voltage at input terminal 301 is anywhere in a range between a threshold voltage of n-type IGFET 303 above the voltage of output terminal 302 and an absolute value of a threshold voltage of p-type IGFET 304 below the voltage of output terminal 302, class B amplifying circuit 300 may be in a dead zone or a high impedance state. In the high-impedance state or dead zone, n-type IGFET 303 and p-type IGFET 304 may both be turned off. In this way, output terminal 302 may not be driven by class B amplifying circuit 300. For example, if the threshold voltage of n-type IGFET 303 is 0.4 V and the threshold voltage of p-type IGFET 304 is −0.4 V and the voltage of output terminal 302 is 2.5 V, an input terminal voltage range of 2.1 V to 2.9 V may be a dead zone in which class B amplifying circuit 300 is in a high impedance state.

When both n-type IGFET 303 and p-type IGFET 34 are enhancement type devices, there may be no condition where both n-type IGFET 303 and p-type IGFET 304 are simultaneously turned on. Thus, a through current or a bias current may not flow from a high voltage power source VDD to a low voltage power source VSS through n-type IGFET 303 and p-type IGFET 304.

Class B amplifying circuit 300 may be conceptualized as a simple complementary source follower circuit that has a bias current that is essentially zero. A voltage range of the dead zone may depend directly on the threshold voltages of n-type IGFET 303 and p-type IGFET 304 because the voltage follower circuits may utilize a threshold voltage drop.

Figure 4:
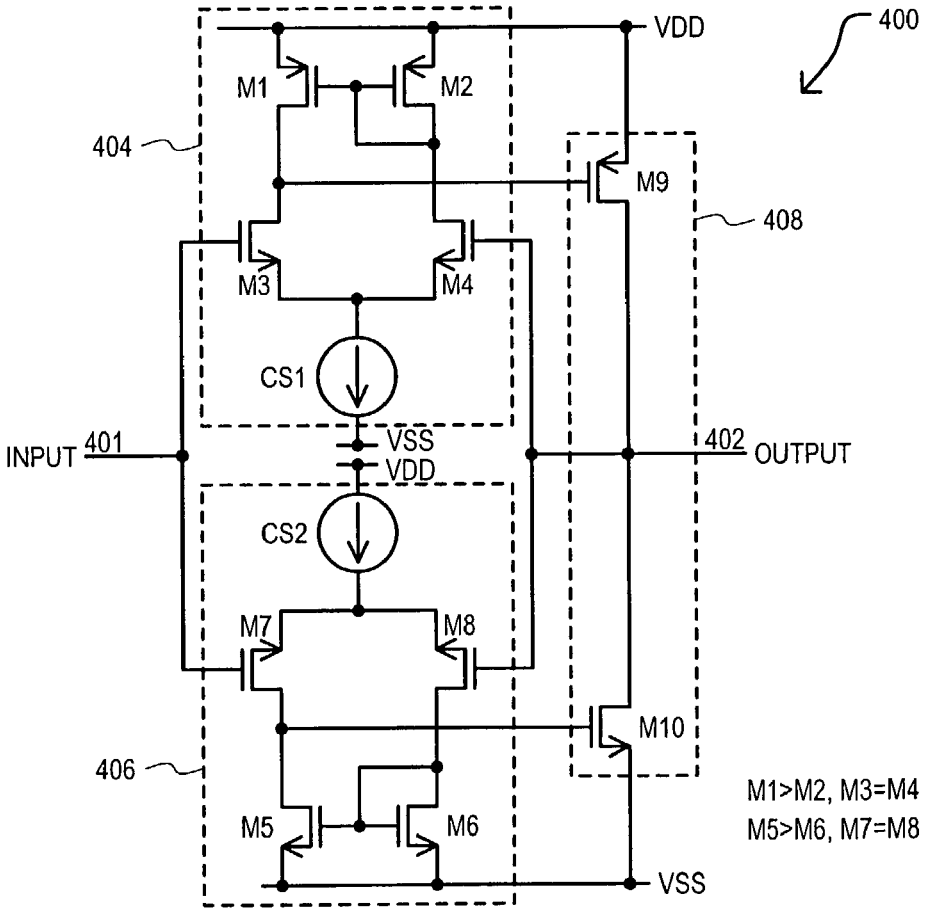
FIG. 4 is a circuit schematic diagram of a class B amplifying circuit according to an embodiment.

Referring now to FIG. 4, a circuit schematic diagram of a class B amplifying circuit according to an embodiment is set forth and given the general reference character 400. Class B amplifying circuit may be used as class B amplifying circuit 35 in display control circuit 100 of FIG. 1. Class B amplifying circuit 400 may include differential amplifying circuits (404 and 406) and a driver circuit 408. Differential amplifying circuits (404 and 406) may utilize a small bias current. However, by utilizing differential amplifying circuits (404 and 406) a dead zone may have a voltage range that may be precisely set. Also, by utilizing differential amplifying circuits (404 and 406) a dead zone may not depend directly on threshold voltages of transistors.

Differential amplifying circuit 404 may include p-type IGFETs (M1 and M2), n-type IGFETs (M3 and M4) and a current source CS1. P-type IGFET M1 may have a source connected to high voltage power source VDD, a drain connected to a gate of a p-type IGFET M9 and a drain of n-type IGFET M3, and a gate connected to a gate and drain of p-type IGFET M2. P-type IGFET M2 may have a source connected to high voltage power source VDD, and a gate and drain commonly connected to a gate of p-type IGFET M1 and a drain of n-type IGFET M4. N-type IGFET M3 may have a gate connected to input terminal 401 and a source commonly connected with a source of n-type IGFET M4 and a first terminal of current source CS1. N-type IGFET M4 may have a gate connected to output terminal 402. Current source CS1 may have a second terminal connected to low voltage power source VSS. In this way, differential amplifier 404 may include a differential input pair (n-type IGFETs (M3 and M4)) with a current mirror load (p-type IGFETs (M1 and M2)).

Differential amplifying circuit 406 may include n-type IGFETs (M5 and M6), p-type IGFETs (M7 and M8) and a current source CS2. N-type IGFET M5 may have a source connected to low voltage power source VSS, a drain connected to a gate of a n-type IGFET M10 and a drain of p-type IGFET M7, and a gate connected to a gate and drain of n-type IGFET M6. N-type IGFET M6 may have a source connected to low voltage power source VSS, and a gate and drain commonly connected to a gate of n-type IGFET M5 and a drain of p-type IGFET M8. P-type IGFET M7 may have a gate connected to input terminal 401 and a source commonly connected with a source of p-type IGFET M8 and a first terminal of current source CS2. P-type IGFET M8 may have a gate connected to output terminal 402. Current source CS2 may have a second terminal connected to high voltage power source VDD. In this way, differential amplifier 406 may include a differential input pair (p-type IGFETs (M7 and M8)) with a current mirror load (n-type IGFETs (M5 and M6)).

Driver circuit 408 may include a p-type IGFET M9 and a n-type IGFET M10. P-type IGFET M9 may have a source connected to high voltage power source VDD, a gate connected to a common drain connection of n-type IGFET M3 and p-type IGFET M1 of differential amplifying circuit 404, and a drain connected to output terminal 402. N-type IGFET M10 may have a source connected to low voltage power source VSS, a gate connected to a common drain connection of n-type IGFET M5 and p-type IGFET M7 of differential amplifying circuit 406, and a drain connected to output terminal 402.

In differential amplifying circuit 404, in order to ensure that p-type IGFET M9 of driver circuit 408 is turned off when a voltage at input terminal 401 is essentially equal to the voltage at output terminal 402, a channel width of p-type IGFET M1 may be set to be larger than that of p-type IGFET M2. If the channel width of p-type IGFET M1 is sufficiently larger than the channel width of p-type IGFET M2, a voltage at a drain of p-type IGFET M1 may be greater than the high voltage power source VDD minus an absolute value of a threshold voltage of p-type IGFET M9 when a voltage at input terminal 401 is essentially equal to the voltage at output terminal 402. In this way, p-type IGFET M9 of driver circuit 408 may be turned off. Thus, by providing a difference between channel widths (current sourcing strengths) of p-type IGFETs (M1 and M2), a dead zone around where a voltage at input terminal 401 is essentially equal to the voltage at output terminal 402 may be established for p-type IGFET M9. It is noted, that the sizes of n-type IGFETs (M3 and M4) may be essentially the same.

Thus, differential amplifying circuit 404 may have an offset voltage. Accordingly, when the voltage of input terminal 401 is higher than that of output terminal 402, p-type IGFET M9 may be turned on. However, when a voltage at input terminal 401 is essentially equal to or lower than the voltage at output terminal 402, p-type IGFET M9 may be turned off.

Similarly, in differential amplifying circuit 406, in order to ensure that n-type IGFET M10 of driver circuit 408 is turned off when a voltage at input terminal 401 is essentially equal to the voltage at output terminal 402, a channel width of n-type IGFET M5 may be set to be larger than that of n-type IGFET M6. If the channel width of n-type IGFET M6 is sufficiently larger than the channel width of n-type IGFET M6, a voltage at a drain of n-type IGFET M5 may be lower than the a threshold voltage of n-type IGFET M10 above low voltage power source VSS when a voltage at input terminal 401 is essentially equal to the voltage at output terminal 402. In this way, n-type IGFET M10 of driver circuit 408 may be turned off. Thus, by providing a difference between channel widths (current sourcing strengths) of n-type IGFETs (M5 and M6), a dead zone around where a voltage at input terminal 401 is essentially equal to the voltage at output terminal 402 may be established for n-type IGFET M10. It is noted, that the sizes of p-type IGFETs (M7 and M8) may be essentially the same.

Thus, differential amplifying circuit 406 may have an offset voltage. Accordingly, when the voltage of input terminal 401 is lower than that of output terminal 402, n-type IGFET M10 may be turned on. However, when a voltage at input terminal 401 is essentially equal to or higher than the voltage at output terminal 402, n-type IGFET M10 may be turned off.

As described above, in class B amplifying circuit 400, when a voltage of input terminal 401 is in a range between an offset voltage of differential amplifying circuit 404 higher than a voltage of output terminal 402 and an offset voltage of differential amplifying circuit 406 lower than a voltage of output terminal 402, class B amplifying circuit 400 is operating in a dead zone. In this dead zone, both p-type IGFET M9 and n-type IGFET M10 may be turned off and the output terminal 402 may be in a high impedance state.

For example, when the offset voltage of differential amplifying circuit 404 is 0.2 V and the offset voltage of differential amplifying circuit 406 is −0.2 V, and the voltage of output terminal 402 is 2 V, a dead zone may occur when a voltage of input terminal is anywhere in a range of 1.8 V to 2.2 V and output terminal 402 may be in a high impedance state. When output terminal 402 is in a high impedance state, driver circuit 408 consumes essentially zero current and only a bias current in differential amplifying circuits (404 and 406) may be consumed. This bias current may be designed to be relatively small.

On the other hand, when a voltage of input terminal 401 is outside of the dead zone, either p-type IGFET M9 or n-type IGFET M10 may be turned on and output terminal 402 may be driven so that a potential difference between input terminal 401 and output terminal 402 may be reduced.

It may be preferable that the offset voltages of differential amplifying circuits (404 and 406) are as close to 0V as possible in order to provide high-speed operations. However, in this case, if offset voltages vary due to process variations caused by manufacturing or the like, a condition may occur where flow through current in driver circuit 408 may occur even when there is no potential difference between the voltage at input terminal 401 and the voltage at output terminal 402. Thus, offset voltages of about 0.2 V to 0.5 V may be preferable.

Referring once again to FIG. 1, the operation of display control circuit 100 according to an embodiment will now be described.

In each output cell (3-1 to 3-N), a class B amplifying circuit 35 may drive a respective output terminal (PS-1 to PS-N) based on a gray level voltage provided from D/A converter 32. Class B amplifying circuit 35 may have a dead zone in which an output may be a high impedance when an input voltage is substantially equal to an output voltage. Thus, class B amplifying circuit 35 may drive an output terminal (PS-1 to PS-N) to a vicinity of a gray level voltage provided by D/A converter 32, but may not drive output terminal (PS-1 to PS-N) to the full gray level voltage. However, a buffer circuit 2 may include class AB amplifying circuits 21. Class AB amplifying circuits 21 may provide amplified reference voltages (VA1 to VA64) to D/A converter 33 in each output cell (3-1 to 3-N). In this way, buffer 2 may drive (through D/A converter 33) output terminal (PS-1 to PS-N) to a desired gray level voltage. Class AB amplifying circuits 21 may be configured as a voltage follower.

In display control circuit 100, two types of amplifying circuits (class AB amplifying circuit 21 through D/A converter 33 and class B amplifying circuit 35) may be used to drive output terminal (PS-1 to PS-N). Thus, the number of amplifying circuits (buffers) for driving the gray level voltage may be increased as compared with conventional display control circuits (1000 and 1100).

However, class B amplifying circuit 35 may have essentially zero through current (current from a high voltage power source to a low voltage power source). Thus, a current consumption may be greatly reduced as compared to using class AB amplifying circuit 1034 as in conventional display control circuit 1000. In addition, class B amplifying circuit 35 may drive output terminal (PS-1 to PS-N) up to the vicinity of a target gray level voltage. Class AB amplifying circuit 21 may drive output terminal (PS-1 to PS-N) the rest of the way (a small increment) to the target gray level voltage. Because class AB amplifying circuit 21 may only be necessary to provide a small incremental fine-tuning of the drive to a gray level voltage, the drive strength of class AB amplifying circuit 21 may be made relatively small as compared to class AB amplifying circuits in buffer 1102 in conventional display control circuit 1100. Accordingly, the power consumption of buffer 2 in display control circuit 100 may be smaller than that of buffer 1102 in conventional display control circuit 1100. As described above, in display control circuit 100, power consumption of class AB amplifying 21 and class B amplifying circuit 35 may be greatly reduced as compared with class AB amplifying circuit 1034 and class AB amplifying circuit in buffer 1102 in conventional display control circuits (1000 and 1100). Therefore, even if the number of amplifying circuits is increased as compared with conventional display control circuits (1000 and 1100), power consumed in display control circuit 100 may be reduced. In particular, according to the embodiment of FIG. 1, the power may be further reduced relative to conventional approaches when the number of output terminals (PS-1 to PS-N) increase.

It should be noted that because class B amplifying circuit 35 may provide a substantial portion of the drive to the gray level voltage, class AB amplifying circuit 21 may have a lower drive strength than class B amplifying circuit 35. By providing class B amplifying circuit 35 with a lower drive strength, static current when a gray level voltage is not switching my be reduced.

Another embodiment will now be described using FIGS. 5 to 9. The embodiment of FIG. 1 is described assuming that a source line (data line) of a display panel may be driven by an output terminal of a display control circuit. However, recently, a TFT liquid crystal display panel may include a selector circuit. An input of a selector circuit may be connected with an output terminal PS of a display control circuit. The selector circuit may be switched in a time division fashion so that a plurality of source lies may be driven in accordance with a signal from an output terminal PS of the display control circuit.

Figure 5:
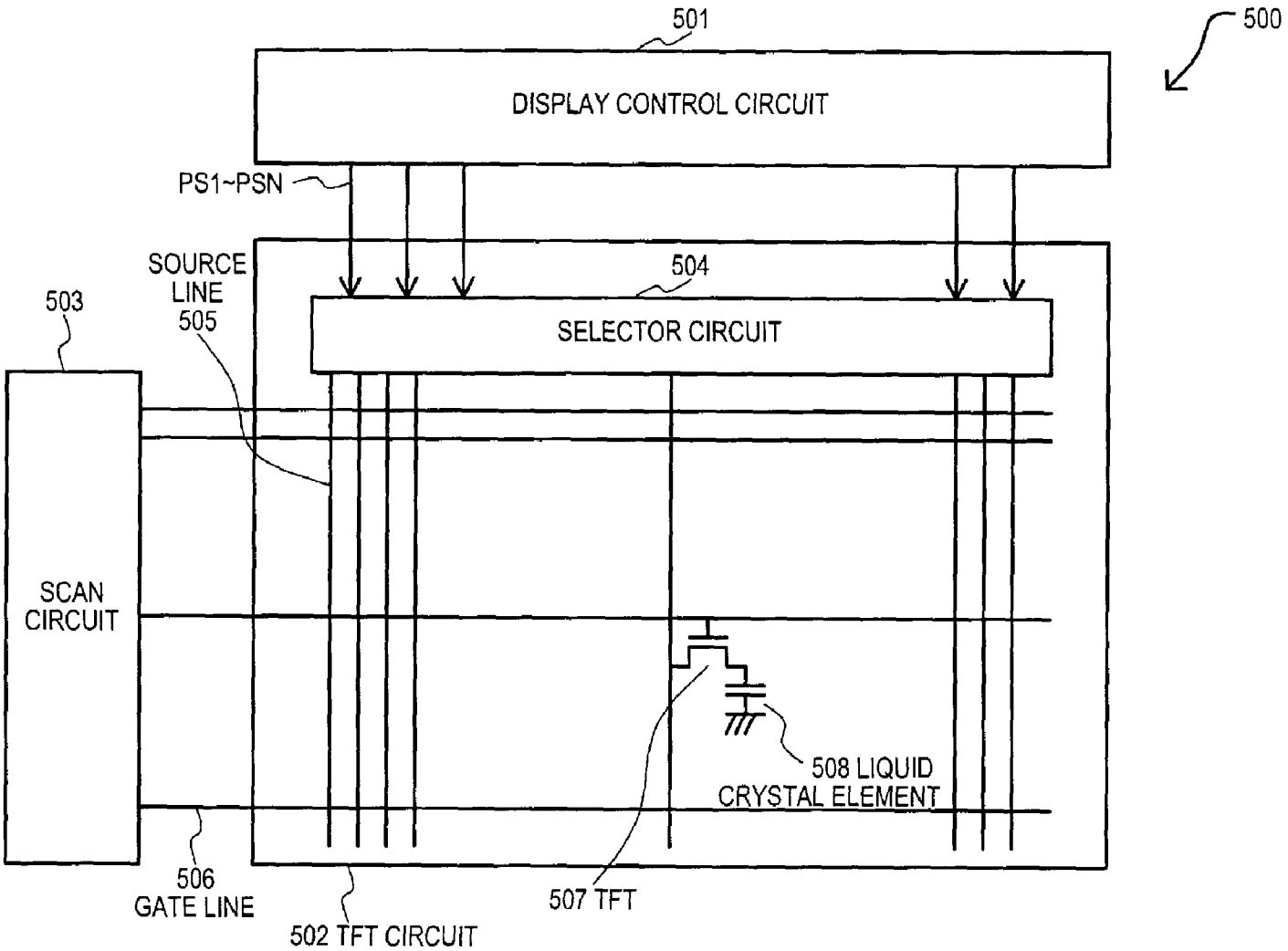
FIG. 5 is a block schematic diagram of a liquid crystal display device according to an embodiment.

Referring now to FIG. 5, a block schematic diagram of a liquid crystal display device according to an embodiment is set forth and given the general reference character 500.

Liquid crystal display device 500 may include a display control circuit 501, a TFT circuit 502, and a scan circuit 503. Display control circuit 501 and scan circuit 503 may be circuits formed on a semiconductor device such as a large scale integration (LSI) semiconductor device. TFT circuit 502 may be formed on a glass substrate or the like and a liquid crystal and a counter electrode may be laminated thereon. TFT circuit 502 may be driven by display control circuit 501 and scan circuit 503 to control a display of the liquid crystal display device 500. Image signals (PS1 to PSN) may be provided from output terminals (PS-1 to PS-N) of display control circuit 501 to TFT circuit 502.

TFT circuit 502 may include a selector circuit 504. Image signals (PS1 to PSN) may be provided to selector circuit 504 from display control circuit 501. Outputs of selector circuit 504 may be connected with N×M source lines 505. Source lines 505 may be divided into N groups, each having M source lines. An image signal PSK of one line (K is an integer of 1 to N) may be connected with one of M source lines in the $K^{th}$ group of source lines 505 through selector circuit 504. Selector circuit 504 may conduct switching in a time division fashion during a scanning period so that respective display control voltages may be separately supplied from one image signal PSK to a source line 505 in the $K^{th}$ group of source lines 505. In this way, during one scan line period M rewrite operations of display data provided from output terminal PS may be executed.

Source lines 505 may be connected with source (drain) terminals of thin film transistors (TFT) 507 arranged in a matrix in TFT circuit 502. A large number of gate lines 506 from scan circuit 503 may be connected with gates of TFTs 507 with one gate line commonly connected to gates of TFTs 507 in a gate line direction. In order to avoid unduly cluttering the figure, only one TFT 507 is illustrated in FIG. 5. Actually, a TFT transistor 507 may be located at each intersection of N×M source lines 505 and a large number of gate lines 506. Each TFT 507 may be a n-type transistor. When a gate line 506 becomes a high level, TFTs 507 connected to the gate line 506 may be turned on and voltages of source lines 505 connected to respective sources (drains) may be accumulated in capacitors composed of liquid crystal elements 508. After that, when the gate line 506 becomes a low level, TFTs 507 connected to the gate line 506 may be turned off and the voltages of liquid crystal elements 508 may be maintained until the TFTs 507 are turned on again. Transmittance and reflectance of light to the respective liquid crystal elements may be controlled by the voltages maintained in respective liquid crystal elements 508 so that light and dark in each display pixel may be obtained to determine a display pattern of liquid crystal display device.

In a source driver (display control circuit 501) for driving the display panel including the selector circuit 504, it may be necessary to drive an output terminal PS by changing display data a plurality of times during a scanning period. Thus, higher speed operation may be required.

Also, a display device may be capable of switching between a gray level display mode in which the number of gray levels for display is large and a gray level display mode in which the number of gray levels for display is small. In this case, when a display control device in which low power consumption is realized while conducting high speed operation, an optimal structure may be changed according to the gray level display mode, i.e. whether the number of gray levels for display is large or small. An embodiment relating to such a display control circuit and a display device will now be described with reference to FIG. 6.

Figure 6:
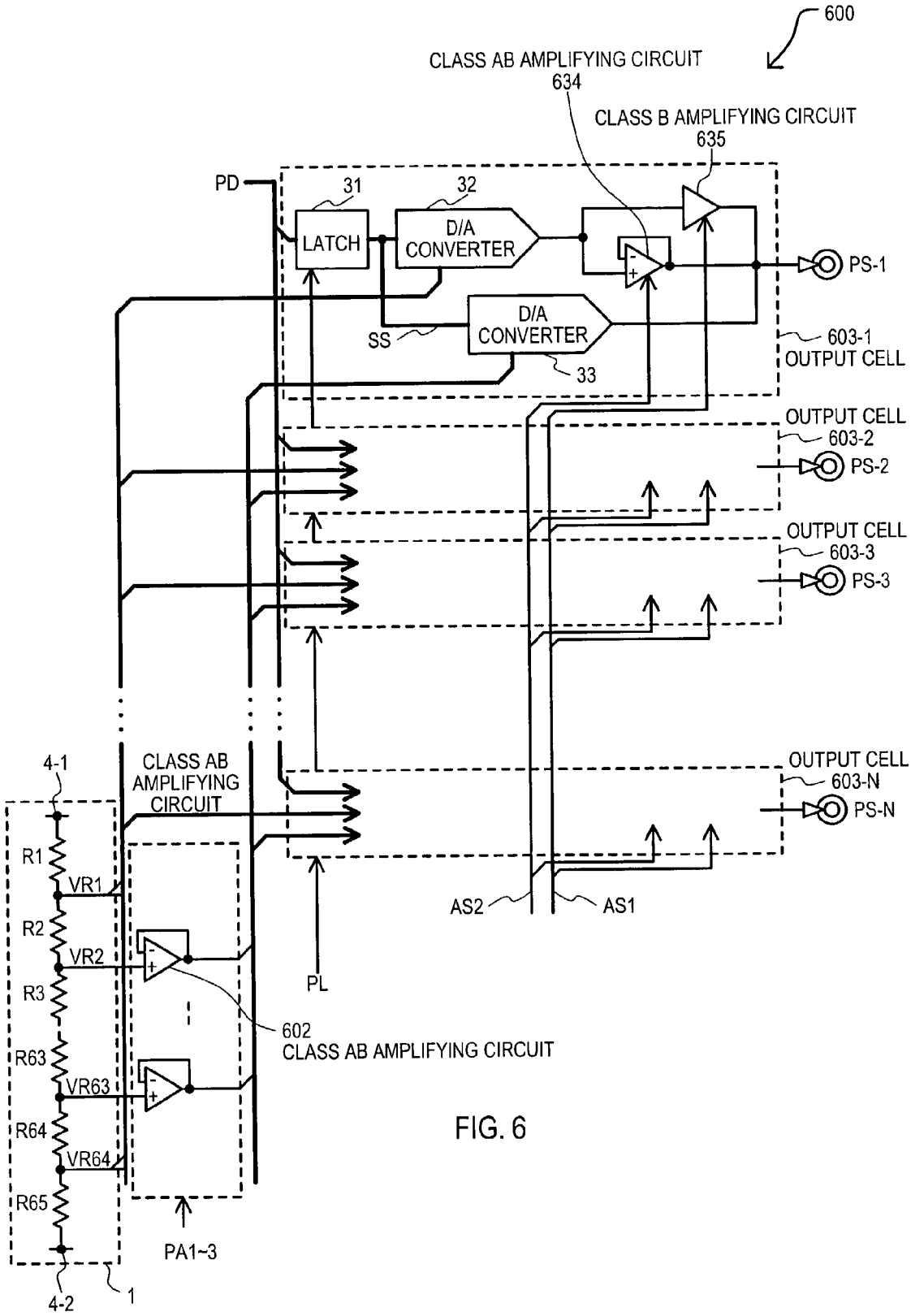
FIG. 6 is a circuit schematic diagram of a display control device according to an embodiment.

Referring now to FIG. 6, a circuit schematic diagram of a display control device according to an embodiment is set forth and given the general reference character 600. Display control device 600 may include similar constituents as display control device 100. Such constituents may be referred to be the same reference character and the description may be omitted. Display control circuit 600 may have 4 modes, a 260,000-color mode using 64-gray level display for each of the primary colors, a 4,096-color mode using 16-gray level display, a 512-color mode using 8-gray level display, and an 8-color mode using 2-gray level display.

In display control circuit 100 of FIG. 1, 64 class AB amplifying circuits 21 may be used to provide amplified reference signals (VA1 to VA64) corresponding to gray level voltages of 64 gray levels. However, in display control circuit 600, 16 class AB amplifying circuits 602 may be provided corresponding to a display mode of 16 or less gray levels. In a display mode of 64 gray levels, the 16 reference voltages of reference voltages (VR1 to VR64) provided for the 16 gray level mode may be provided to the 16 class AB amplifying circuits 602. Class AB amplifying circuits 602 may be activated/non-activated by selection signals (PA1 to PA3). When non-activated, a class AB amplifying circuit 602 may be in a high impedance state and a current consumption may be essentially zero. Of the 16 class AB amplifying circuits 602, selection signal PA1 may be provided as a selection signal to 2 class AB amplifying circuits 602 used for a 2-gray level display. Selection signal PA2 may be provided to 6 class AB amplifying circuits 602 used in the 8-gray level display and which are not used for the 2-gray level display. Selection signal PA3 may be provided to 8 class AB amplifying circuits 602 used in the 16-gray level display and which are not used for the 8-gray level display. For example, when a class AB amplifying circuit 200 of FIG. 2 is used as class AB amplifying circuit 602, a selection signal (PA1 to PA3) may be provided to terminal AC and a logical inversion of the selection signal (PA1 to PA3) may be provided to terminal ACB.

In each output cell (603-1 to 603-N) in display control circuit 600, a class AB amplifying circuit 634 and a class B amplifying circuit 635 may be connected in parallel between D/A converter 32 and output terminal (PS-1 to PS-N). Further, class B amplifying circuit 35 may receive a selection signal AS1 and class AB amplifying circuit 634 may receive a selection signal AS2. In this way, amplifying circuits (635 and 634) which are selected by selection signals (AS1 and AS2), respectively, may be activated and unselected amplifying circuits (635 and 634) may be non-activated. Class AB amplifying circuit 200 illustrated in FIG. 2 may be used as class AB amplifying circuits 634. In this case, selection signal AS2 may be provided to terminal AC and a logical inversion of selection signal AS2 may be provided to terminal ACB.

Also, with respect to class B amplifying circuit 635, a function for non-activating in response to selection signal AS1 may be added to class B amplifying circuit 35 shown in FIG. 1, for example.

When a selection signal AS1 becomes a low level, the output of class B amplifying circuit 635 may become a high impedance without depending on an input signal. In the high impedance state, current consumption in class B amplifying circuit 635 may be essentially zero.

Figure 7:
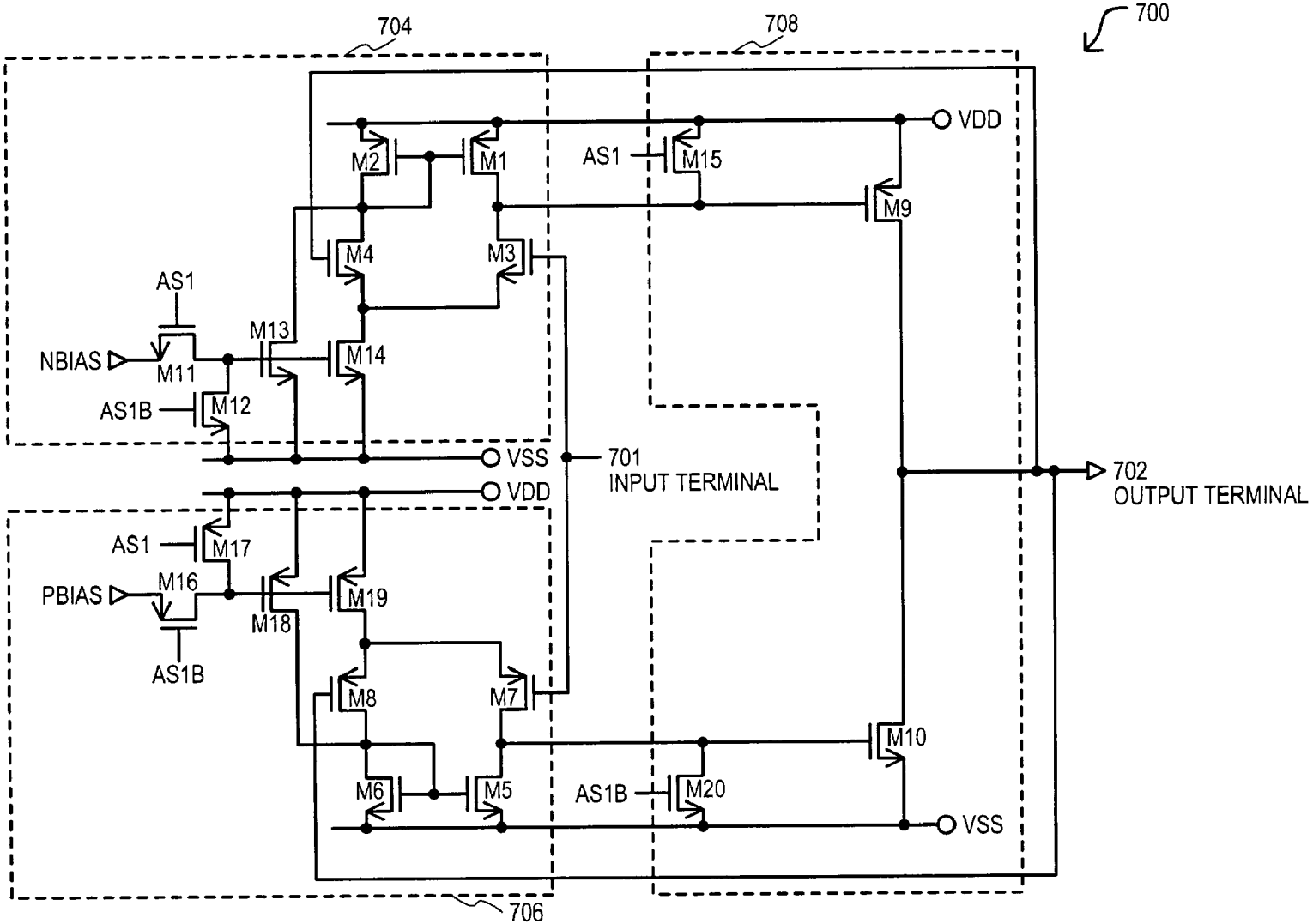
FIG. 7 is a circuit schematic diagram of a class B amplifying circuit according to an embodiment.

Referring now to FIG. 7, a circuit schematic diagram of a class B amplifying circuit according to an embodiment is set forth and given the general reference character 700. Class B amplifying circuit 700 may be used as class B amplifying circuit 635 in display control circuit 600. Class B amplifying circuit 700 may include similar constituents as class B amplifying circuit 400 of FIG. 4. Such constituents may be referred to by the same reference character. Class B amplifying circuit 700 may include differential amplifying circuits (704 and 706) and a driver circuit 708.

Differential amplifier circuit 704 may differ from differential amplifier circuit 404 in that n-type IGFET M14 may be included instead of constant current source CS1 and n-type IGFETs (M11 to M13) may be included. N-type IGFET M14 may have a drain connected to a common source of n-type IGFETs (M3 and M4), a source connected to low voltage power source VSS, and a gate connected to a common drain connection of n-type IGFETs (M11 and M12). N-type IGFET M11 may have a source connected to receive a bias potential NBIAS, a gate connected to receive selection signal AS1 and a drain connected to gates of n-type IGFETs (M13 and M14) and a drain of n-type IGFET M12. N-type IGFET M12 may have a source connected to low voltage power source VSS and a gate connected to receive inverted selection signal AS1B. N-type IGFET M13 may have a source connected to low voltage power source VSS and a drain connected to a common connection between the drains of n-type IGFET M4 and p-type IGFET M2 and gates of p-type IGFETs (M1 and M2).

Differential amplifier circuit 706 may differ from differential amplifier circuit 406 in that p-type IGFET M19 may be included instead of constant current source CS2 and p-type IGFETs (M16 to M18) may be included. P-type IGFET M19 may have a drain connected to a common source of p-type IGFETs (M7 and M8), a source connected to high voltage power source VDD, and a gate connected to a common drain connection of p-type IGFETs (M16 and M17). P-type IGFET M16 may have a source connected to receive a bias potential PBIAS, a gate connected to receive inverted selection signal AS1B and a drain connected to gates of p-type IGFETs (M18 and M19) and a drain of n-type IGFET M17. P-type IGFET M17 may have a source connected to high voltage power source VDD and a gate connected to receive selection signal AS1. P-type IGFET M18 may have a source connected to high voltage power source VDD and a drain connected to a common connection between the drains of p-type IGFET M8 and n-type IGFET M6 and gates of n-type IGFETs (M5 and M6).

Driver circuit 708 may differ from driver circuit 408 in that p-type IGFET M15 and n-type IGFET M20 may be included. P-type IGFET M15 may have a source connected to high voltage power source VDD, a drain connected to a gate of p-type IGFET M9 and a common drain connection of p-type IGFET M1 and n-type IGFET M3, and a gate connected to receive selection signal AS1. N-type IGFET M20 may have a source connected to low voltage power source VSS, a drain connected to a gate of n-type IGFET M10 and a common drain connection of n-type IGFET M5 and p-type IGFET M7, and a gate connected to receive inverted selection signal AS1B.

The operation of class B amplifying circuit 700 may be essentially the same as class B amplifying circuit 400 when selection signal AS1 is at a high level and inverted selection signal AS1B is at a low level.

On the other hand, when selection signal AS1 is a low level and inverted selection signal AS1B is a high level, n-type IGFET M12 may be turned on, n-type IGFET M11 may be turned off, p-type IGFET M17 may be turned on, and p-type IGFET M16 may be turned off. With n-type IGFET M12 turned on, the gates of n-type IGFETs (M13 and M14) may be pulled low. With p-type IGFET M17 turned on, the gates of p-type IGFETs (M18 and M19) may be pulled high. With a low gate voltage n-type IGFETs (M13 and M14) may be turned off. With a high gate voltage p-type IGFETs (M18 and M19) may be turned off. In this way, a bias current may not flow through differential amplifier circuits (704 and 706).

Also, with selection signal AS1 low, p-type IGFET M15 may be turned on and the gate of p-type IGFET M9 may be pulled to the high voltage power source VDD. With inverted selection signal AS1B high, n-type IGFET M20 may be turned on and the gate of n-type IGFET M10 may be pulled to the low voltage power source VSS. As a result, p-type IGFET M9 and n-type IGFET M10 may be turned off and output terminal 702 may be at a high impedance without depending on the voltage of input terminal 701. In this way, current consumption of driver circuit 708 may be essentially zero.

Respective display modes and operations of display control circuit 600 of FIG. 6 will now be described.

First, the operation of the 260,000-color mode will be described.

In the 260,000-color mode, selection signals (AS1, PA1, PA2, and PA3) may each be set at a low level and selection signal AS2 may be set at a high level. In respective output cells (603-1 to 603-N), selection signal AS1 may be set to a low level and selection signal AS2 may be set to a high level. Thus, class AB amplifying circuits 634 may be activated and class B amplifying circuits 635 may be non-activated. In addition, selection signals (PA1 to PA3) provided to class AB amplifying circuits 602 may each be set to a low level. In this way, all 16 γ-power source amplifying circuits (class AB amplifying circuits 602) may be non-activated. Thus, the outputs of class AB amplifying circuits 602 may be set to a high impedance state. In the high impedance state, only a leakage current may flow through each class AB amplifying circuit 602 and current consumption may be substantially zero. With the output of class AB amplifying circuits 602 being a high impedance state, D/A converter 33 may also provide a high impedance output regardless of the value of selection signal SS. Latch 31 may latch a 6-bit image data signal PD. The 6-bit image data signal PD may be decoded by D/A converter 32 to select a gray level voltage from 64-gray level voltages of reference voltage signals (VR1 to VR64) provided by γ power source generating circuit 1. In this way, D/A converter 32 may provide a gray level voltage to class B amplifying circuit 635.

At this time, display control circuit 600 may substantially operate as a circuit equivalent to conventional display control circuit 1000 in which an output terminal is directly driven by a class AB amplifying circuit. In addition, at this time, the current consumption of display control circuit 600 may be essentially equal to conventional display control circuit 1000.

Next, the operation of the 4,096-color mode will be described.

In the 4,096-color mode, selection signal AS1 may be set to a high level and selection signal AS2 may be set to a low level. In respective output cells (603-1 to 603-N), when selection signal AS1 having a high level and selection signal AS2 having a low level are applied to amplifying circuits (635 and 634), respectively, class B amplifying circuits 635 may be activated and class AB amplifying circuits 634 may be non-activated. Thus, the outputs of non-activated class AB amplifying circuits 634 may be high impedance. In addition, in the 4,096-color mode, selection signals (PA1 to PA3) may each be set to a high level. Thus, all 16 class AB amplifying circuits 602 may be activated. In the 4,096-color mode, of the 6-bit image data signal PD latched by latch 31, the higher order 4 bits may be decoded by D/A converters (32 and 33). In this way, a gray level voltage from 16-gray level voltages provided from class AB amplifying circuits 602 and provided directly from γ power source 1 may be selected to provide a gray level voltage to output terminal (PS-1 to PS-N). In the 4,096-color mode, all class AB amplifying circuits 634 may be non-activated and may therefore consume essentially zero current. Instead of this, class B amplifying circuits 635 may be activated. Thus, power consumption may be lower than the power consumption in the 260,000-color mode.

The operation of the 512-color mode will now be described.

The 512-color mode may differ from the 4,096-color mode in that selection signals (PA1 and PA2) may be set to a high level and selection signal PA3 may be set to a low level. Of the 16 class AB amplifying circuits 602, only the 8 of 16 class AB amplifying circuits 602 providing an amplified reference signal corresponding to the voltages for an 8-gray level display may be activated. On the other hand, the other 8 of 16 class AB amplifying circuits 602 may be non-activated so that their outputs may be high impedance and current consumption may be essentially zero. In the 512-color mode, of the 6-bit image data signal PD latched by latch 31, the higher order 3 bits may be decoded by D/A converters (32 and 33). In this way, a gray level voltage from 8-gray level voltages provided from class AB amplifying circuits 602 and provided directly from γ power source 1 may be selected to provide a gray level voltage to output terminal (PS-1 to PS-N). In the 512-color mode, all class AB amplifying circuits 634 may be non-activated and may therefore consume essentially zero current. Instead of this, class B amplifying circuits 635 may be activated. Because only 8 of 16 class AB amplifying circuits 602 are activated in the 512-color mode, the power consumption may be further reduced as compare with the 4,096-color mode.

Finally, the operation of the 8-color mode will be described.

The 8-color mode may differ from the 512-color mode and the 4,096-color mode in that selection signal PA1 may be set to a high level and selection signals (PA2 and PA3) may be set to a low level. Only 2 of the 16 class AB amplifying circuits 602 may be activated. The other 14 of 16 class AB amplifying circuits 602 may be non-activated so that their outputs may be high impedance and current consumption may be essentially zero. In the 8-color mode, of the 6-bit image data signal PD latched by latch 31, the higher order 1 bit may be decoded by D/A converters (32 and 33). In this way, a gray level voltage from 2-gray level voltages provided from class AB amplifying circuits 602 and provided directly from γ power source 1 may be selected to provide a gray level voltage to output terminal (PS-1 to PS-N). In the 8-color mode, all class AB amplifying circuits 634 may be non-activated and may therefore consume essentially zero current. Instead of this, class B amplifying circuits 635 may be activated. Because only 2 of 16 class AB amplifying circuits 602 are activated in the 8-color mode, the power consumption may be further reduced as compare with the 512-color mode.

It should be noted that because class B amplifying circuit 635 may provide a substantial portion of the drive to the gray level voltage, class AB amplifying circuit 634 may have a lower drive strength than class B amplifying circuit 635.

As described above, when class B amplifying circuit 635 is used to directly drive an output terminal (PS-1 to PS-N) in an output cell (603-1 to 603-N), power consumption of a final stage may be reduced as compared to a case where a class AB amplifying circuit is used. The amplifying circuit of the final stage may be provided for each output terminal (PS-1 to PS-N). Thus, such an effect may increase as the number of output terminals increases. Note, when a class B amplifying circuit is used, a class AB amplifying circuit connected as a voltage follower may be conducted in a stage preceding the A/D converter, or the like, for providing compensation to drive the output terminal to a target voltage after the output terminal is driven up to the vicinity of the target voltage by the class B amplifying circuit. Also note, the class B amplifying circuit may provide a high impedance when the output terminal is driven in the vicinity of the target voltage. The number of class AB amplifying circuits may correspond to the number of gray levels for display. In this way, power consumption of class AB amplifying circuits in the stage preceding an A/D converter may be increased as the number of gray levels for display increases.

On the other hand, when a class AB amplifying circuit is used as an amplifying circuit of a final stage, the power consumption of the final stage may become larger than a case in which a class B amplifying circuit is used in the final stage. However, when a class AB amplifying circuit is used, even if an input voltage and an output voltage are substantially equal to each other, the output of the class AB amplifying circuit does not become a high impedance. Thus, the compensation circuit may be unnecessary.

In other words, when the number of output terminals is larger than the number of gray levels for display, the output terminal may be driven by a class B amplifying circuit and the compensation circuit so that the power consumption may be reduced as compared with a case where the output terminal is directly driven by the class AB amplifying circuit. However, when the number of gray levels for display is large and the number of output terminals is small, the power consumption in the case where the output terminal is directly driven by the class AB amplifying circuit may be reduced as compared with the case where the class B amplifying circuit is used. According to display control circuit 600, based on findings of the inventor, when the number of gray levels for display is large, the output terminal may be driven by the class AB amplifying circuit. When the number of gray levels for display is small, the output terminal may be driven by the class B amplifying circuit and the compensation circuit (buffer formed by class AB amplifying circuits 602). Thus, high speed performance and low power consumption of delay control circuit 600 as a source driver may be achieved. In particular, when a display panel including a selector circuit therein is driven, the number of output terminals does not become larger and high speed operation may be required. Thus, such an effect may be large.

Figure 8:
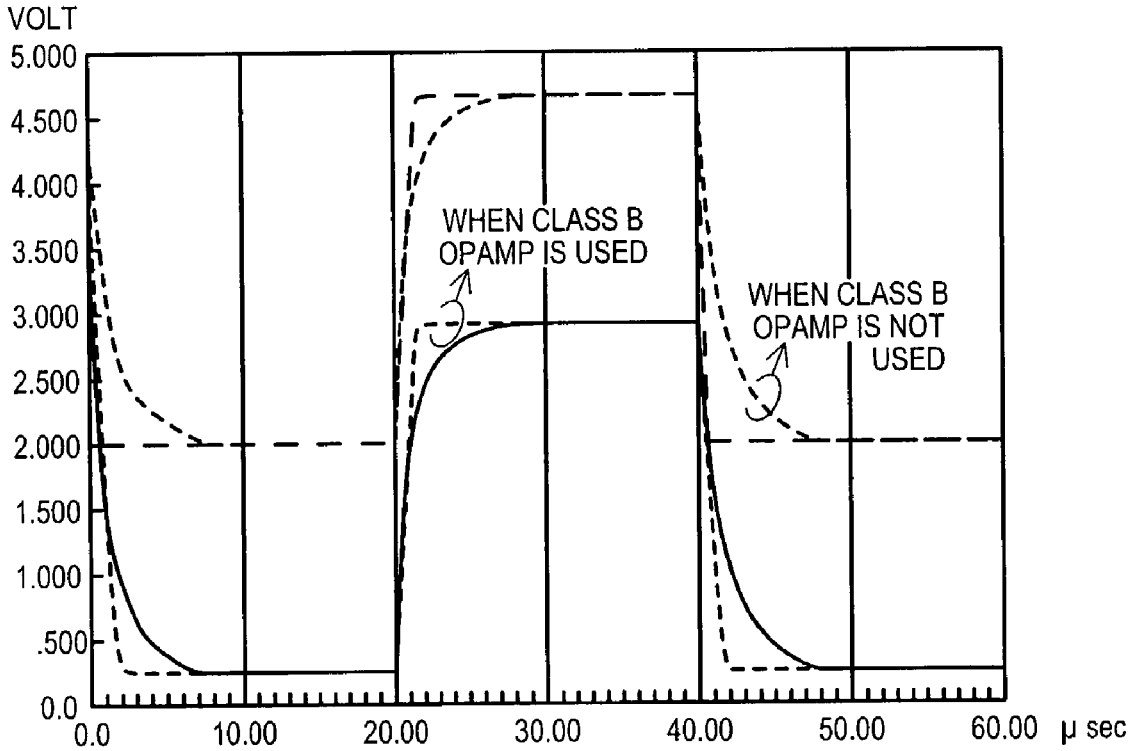
FIG. 8 is a simulation waveform diagram of a display control circuit of FIG. 6 according to an embodiment.

Referring now to FIG. 8, a simulation waveform diagram of display control circuit 600 of FIG. 6 according to an embodiment is set forth. From viewing FIG. 8, it can be seen that high speed rise and high speed fall of an output terminal PS may be realized by using a class B amplifying circuit as compared with a case where the output terminal PS is charged and discharged by a class AB amplifying circuit though a D/A converter.

Figure 9:
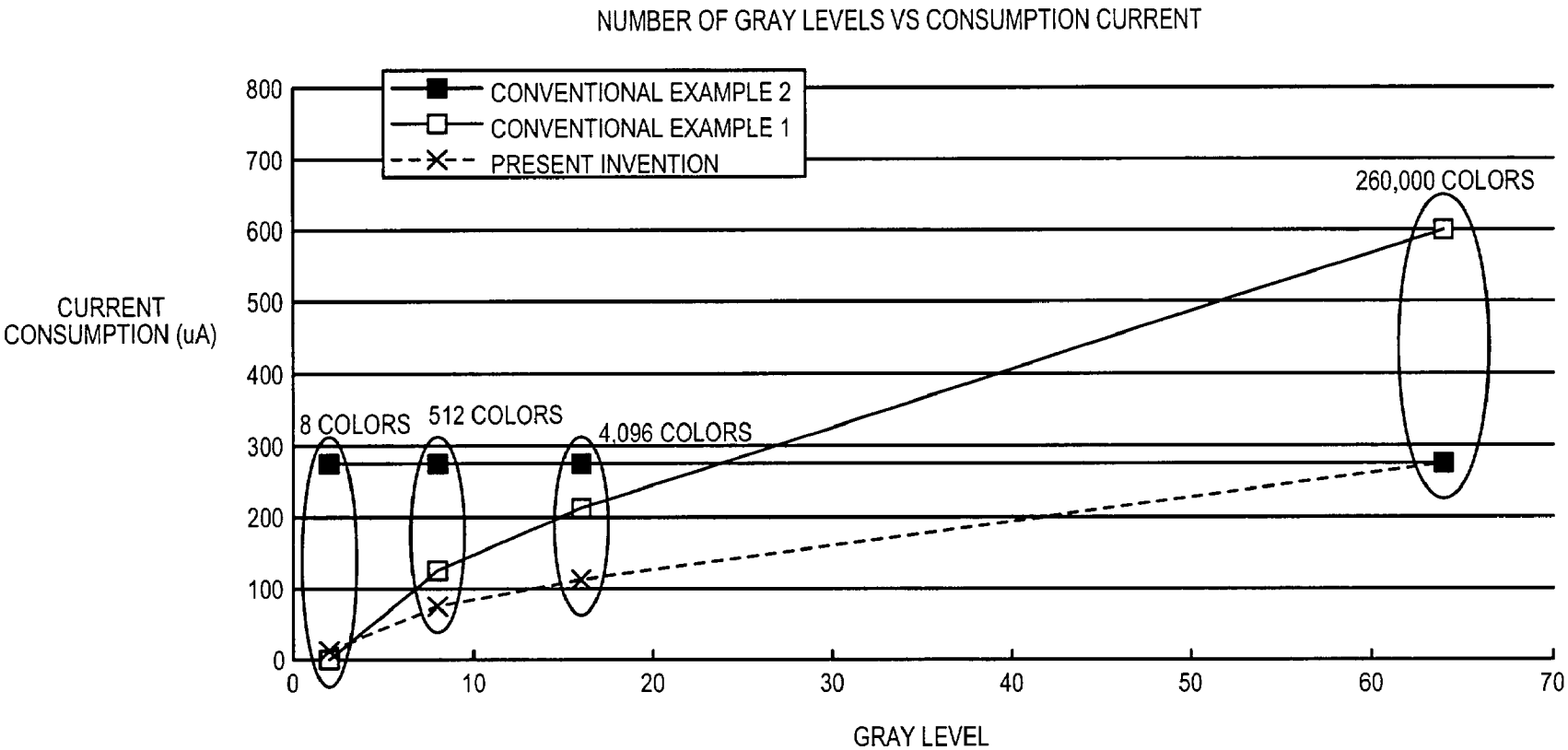
FIG. 9 is a graph showing results of a trial calculation of current consumption for conventional display control circuits and a display control circuit according to an embodiment.

Referring now to FIG. 9, a graph showing results of a trial calculation of current consumption for conventional display control circuits and a display control circuit according to an embodiment is set forth. The graph of FIG. 9 illustrates current consumption for conventional display control circuit 1000 (conventional example 1), conventional display control circuit 1100 (conventional example 2), and display control circuit 600 (present invention) for a 260,000-color mode, a 4,096 color mode, a 512-color mode, and an 8-color mode. In the calculations of current consumption in FIG. 9, it is assumed that the number of output terminals N is 24 and the number of division M is 22.

As described above, in the case of the 260,000-color mode, the current consumption of display control circuit 600 may be substantially equal to conventional example 1 in which the output terminal is directly driven by using a class AB amplifying circuit. Next, in the cases of the 512-color mode and the 4,096-color mode, small power consumption may be realized with display control circuit 600 as compared with conventional example 1 or conventional example 2. This is because the output terminal may be driven to a vicinity of a target voltage by a class B amplifying circuit so that the power consumption of the output stage may be reduced.

Note that, in display control circuit 600, an example of a display control circuit which may be preferable for controlling display of the TFT liquid crystal display device is described. The display device may be a display device other than a TFT liquid display device, for example, an active matrix drive organic EL (electro-luminescent) display device or the like, as just one example. In the organic EL display device, brightness is changed according to a current flowing into an element. Thus, a circuit for converting a voltage supplied to a data line (corresponding to source line 505 in TFT liquid crystal display device 500 shown in FIG. 5) into a current, or the like may be included. A circuit for controlling the brightness of the organic EL display element based on the voltage supplied to such a data line is known and described in, for example, FIG. 7 of JP 2001-083924 A. Thus, it is not described here in detail.

Also, in FIG. 5, an active matrix type display device in which a transistor is included in each unit pixel is described. However, if a display device in which display is controlled based on a voltage supplied to the data line is used, the present invention is not limited to an active matrix type, but other display devices may be used.

Furthermore, the display device of the present invention may be obtained by integrally forming the display control circuit and active matrix circuit simultaneously and forming thin film transistors on a glass substrate or the like.

As described above, according to the embodiments, an amplifying circuit in which an output may become a high impedance when a voltage of an input and a voltage of the output are at least substantially the same may be provided between a circuit for generating a gray level voltage to be output according to image data and an output terminal. Further, a drive voltage compensation circuit for compensating a voltage level of the output terminal based on the gray level voltage to be output may be provided. Thus, the display control circuit as a source driver in which high speed operation may be conducted without timing control and low power consumption may be realized can be provided.

Also, in a display device in which display by a plurality of unit pixels arranged in a matrix in the vicinities of respective intersections of a plurality of data lines and a plurality of scan lines may be controlled based on voltages applied to the data lines and the scan lines. When the data lines are driven by the display control circuit, low power consumption of the display device may be realized.

It is understood that the embodiments described above are exemplary and the present invention should not be limited to those embodiments. Specific structures should not be limited to the described embodiments.

Thus, while the various particular embodiments set forth herein have been described in detail, the present invention could be subject to various changes, substitutions, and alterations without departing from the spirit and scope of the invention. Accordingly, the present invention is intended to be limited only as defined by the appended claims.

What is claimed is:

1. A display control circuit, comprising:

an amplifying circuit coupled to receive a first gray level voltage at an amplifying circuit input and providing an amplifying circuit output having a high impedance in response to the first gray level voltage and a voltage level of the amplifying circuit output being at least substantially the same; and a drive voltage compensation circuit for compensating the voltage level of the amplifying circuit output based on the first gray level voltage a wherein the display control circuit drives a plurality of output terminals based on different display data; and each one of the plurality of output terminals is associated with a corresponding amplifying circuit, first selector, and second selector and is coupled to a corresponding amplifying circuit output.

2. The display control circuit according to claim 1, wherein:

the amplifying circuit includes an n-type insulated gate field effect transistor (IGFET) having a drain coupled to a high potential power source, a gate coupled to the amplifying circuit input, and a source coupled to the amplifying circuit output, and a p-type IGFET having a drain coupled to a low potential power source, a gate coupled to the amplifying circuit input, and a source coupled to the amplifying circuit output.

3. The display control circuit according to claim 1, wherein:

the amplifying circuit includes a first differential input circuit with a first input coupled to the amplifying circuit input and a second input coupled to the amplifying circuit output and a first output coupled to provide control for turning on and turning off a first driver circuit; and a second differential input circuit with a third input coupled to the amplifying circuit input and a fourth input coupled to the amplifying circuit output and a second output coupled to provide control for turning on and turning off a second driver circuit.

4. The display control circuit according to claim 3, wherein:

the first output driver circuit raises the voltage of the amplifying circuit output when turned on in response to the voltage of the amplifying circuit input being higher than the voltage of the amplifying circuit output; and the second output driver circuit lowers the voltage of the amplifying circuit output when turned on in response to the voltage of the amplifying circuit input being lower than the voltage of the amplifying circuit output.

5. The display control circuit according to claim 1, further including:

a voltage generating circuit providing a plurality of reference voltages;

the first selector circuit for selecting the first gray level voltage from the plurality of reference voltages based on a display data; and the drive voltage compensation circuit includes a buffer circuit coupled to receive the plurality of reference voltages and providing a plurality of buffered reference voltages; and the second selector circuit for selecting one of the plurality of buffered reference voltages based on the display data and providing the one of the plurality of buffered reference voltages to the amplifying circuit output.

6. The display control circuit according to claim 5, wherein:

the buffer circuit includes a plurality of operational amplifying circuits, each one of the plurality of operational amplifying circuits configured as a voltage follower and coupled to receive one of the plurality of reference voltages and provide one of the buffered reference voltages.

7. A display control circuit for driving each of a plurality of output terminals to a predetermined gray level voltage selected from a plurality of gray level voltages based on display data, comprising:

a plurality of output circuits, each output circuit including a first amplifying circuit coupled to receive essentially the predetermined gray level voltage at a first amplifying circuit input and having a first amplifying circuit output connected to a corresponding one of the plurality of output terminals and having a dead zone in which the first amplifying circuit output becomes a high impedance when the corresponding one of the output terminals has a voltage level that is substantially the predetermined gray level voltage; and a second amplifying circuit coupled to receive essentially the predetermined gray level voltage and having a second amplifying circuit output connected to the corresponding one of the plurality of output terminals and not having the dead zone.

8. The display control circuit according to claim 7, wherein:

the first amplifying circuit is coupled to receive a first control signal for setting the first amplifying circuit into an active/non-active state.

9. The display control circuit according to claim 7, wherein:

the second amplifying circuit is coupled to receive a second control signal for setting the second amplifying circuit into an active/non-active state.

10. The display control circuit according to claim 7, wherein:

the first amplifying circuit includes an n-type insulated gate field effect transistor (IGFET) having a drain coupled to a high potential power source, a gate coupled to the first amplifying circuit input, and a source coupled to the first amplifying circuit output; and a p-type IGFET having a drain coupled to a low potential power source, a gate coupled to the first amplifying circuit input, and a source coupled to the first amplifying output.

11. The display control circuit according to claim 7, wherein:

the first amplifying circuit includes a first differential input circuit having a first input coupled to receive essentially the predetermined gray level voltage and a second input coupled to the output terminal and providing a first driver control signal;

a second differential input circuit having a third input coupled to receive essentially the predetermined gray level voltage and a fourth input coupled to the output terminal and providing a second driver control signal; and a driver circuit coupled to receive the first and second driver control signals and providing the first amplifying circuit output.

12. The display control circuit according to claim 7, further including:

a reference voltage generating circuit providing a plurality of reference voltages; and each output circuit includes a first selector coupled to receive the reference voltages and provide the essentially the predetermined gray level voltage based on the display data.

13. The display control circuit according to claim 7, further including:

a reference voltage generating circuit providing a plurality of reference voltages;

a buffer circuit including a plurality of third amplifier circuits and providing a plurality of buffered reference voltages to each of the plurality of output circuits wherein the number of the plurality of third amplifier circuits that are enabled depends on a gray level number mode of operation.

14. A display control circuit for driving each of a plurality of output terminals to a predetermined gray level voltage selected from a plurality of gray level voltages based on display data, comprising:

a buffer including a plurality of first amplifying circuits receiving a plurality of reference voltages and providing a plurality of buffered reference voltages essentially corresponding to the plurality of gray level voltages; and a plurality of output circuits, each output circuit including a second amplifying circuit coupled to receive essentially the predetermined gray level voltage at a second amplifying circuit input and having a second amplifying circuit output connected to a corresponding one of the plurality of output terminals and having a dead zone in which the second amplifying circuit output enters a high impedance state when the corresponding one of the output terminals has a voltage level that is substantially the predetermined gray level voltage wherein the plurality of first amplifying circuits do not have the dead zone and the buffer drives each of the output terminals to the corresponding predetermined gray level voltage.

15. The display control circuit according to claim 14, further including:

a reference voltage generator providing the plurality of reference voltages; and each output circuit including a first selector coupled to receive the plurality of reference voltages and providing the essentially the predetermined gray level voltage to the second amplifying circuit based on the display data.

16. The display control circuit according to claim 15, wherein:

each output circuit further includes a second selector coupled to receive the plurality of buffered reference voltages and providing the predetermined gray level voltage to the output terminal based on the display data.

17. The display control circuit according to claim 14, wherein:

the second amplifying circuit includes an n-type insulated gate field effect transistor (IGFET) having a drain coupled to a high potential power source, a gate coupled to the second amplifying circuit input, and a source coupled to the second amplifying circuit output; and a p-type IGFET having a drain coupled to a low potential power source, a gate coupled to the second amplifying circuit input, and a source coupled to the second amplifying output.

18. The display control circuit according to claim 14, wherein:

the second amplifying circuit includes a first differential input circuit having a first input coupled to receive the essentially the gray level voltage and a second input coupled to the output terminal and providing a first driver control signal;

a second differential input circuit having a third input coupled to receive the essentially the gray level voltage and a fourth input coupled to the output terminal and providing a second driver control signal; and a driver circuit coupled to receive the first and second driver control signals and providing the second amplifying circuit output.

19. The display control circuit according to claim 14, wherein:

the display control circuit controls a display device in which a plurality of unit pixels are arranged in a matrix in vicinities of respective intersections of a plurality of data lines and a plurality of scan lines and the plurality of data lines are driven by the plurality of output terminals.

* * * * *